US010160570B2

(12) United States Patent
Ragha

(10) Patent No.: US 10,160,570 B2
(45) Date of Patent: Dec. 25, 2018

(54) DRY GOODS FILTERING STORAGE CONTAINER

(71) Applicant: Vimal Ragha, Amarillo, TX (US)

(72) Inventor: Vimal Ragha, Amarillo, TX (US)

( * ) Notice: Subject to any disclaimer, the term of this patent is extended or adjusted under 35 U.S.C. 154(b) by 861 days.

(21) Appl. No.: 14/476,733

(22) Filed: Sep. 3, 2014

(65) Prior Publication Data

US 2015/0060463 A1 Mar. 5, 2015

Related U.S. Application Data

(60) Provisional application No. 61/873,023, filed on Sep. 3, 2013.

(51) Int. Cl.

| | |
|---|---|
| ***B65D 25/00*** | (2006.01) |
| ***B65D 25/04*** | (2006.01) |
| ***B65D 81/26*** | (2006.01) |
| ***B65D 43/16*** | (2006.01) |

(52) U.S. Cl.

CPC ..... *B65D 25/04* (2013.01); *B65D 43/161* (2013.01); *B65D 81/262* (2013.01)

(58) Field of Classification Search

CPC .... B65D 25/24; B65D 43/161; B65D 81/262; A47J 47/04

USPC ..... 220/554

See application file for complete search history.

(56) References Cited

U.S. PATENT DOCUMENTS 1,198,938 A * 9/1916 McClarrinon ..... A23L 7/187 16/307
2,071,960 A * 2/1937 Wilson ..... B65D 47/286 222/542
D284,728 S * 7/1986 Trivison ..... D7/629
4,836,370 A 6/1989 Bosshard
4,889,619 A * 12/1989 Lynch ..... B07B 1/00 209/260
4,942,277 A * 7/1990 Narberes ..... B65D 81/3453 209/235
5,215,196 A * 6/1993 Valls ..... A47J 36/20 209/370
5,332,102 A * 7/1994 Sennett ..... A47J 36/20 209/417
5,485,923 A * 1/1996 Schrepfer ..... B07B 1/00 209/235

(Continued)

FOREIGN PATENT DOCUMENTS

WO WO/2013/061316 2/2013

*Primary Examiner* — Ernesto Grano

(74) *Attorney, Agent, or Firm* — Shannon L Warren

(57) ABSTRACT

A dry goods filtering storage container comprising dry goods container comprising a removable top portion, a body portion, a one or more chambers, a height, a width, a depth, a first side, a second side, a front side, a back side, a top, a bottom, a one or more hinged closures and a one or more lid apertures. Said one or more hinged closures are capable of selectively covering said one or more lid apertures. Said one or more chambers comprising a one or more upper chambers and a one or more lower chambers. Said one or more upper chambers are separated by a one or more horizontal dividers. Said one or more horizontal dividers having a plurality of divider apertures. Said dry goods filter storage container holds dry goods of varying sizes. Said one or more chambers being separated by a one or more vertical dividers. Said removable top portion comprises a one or more hinged closures.

8 Claims, 28 Drawing Sheets

(56) References Cited

U.S. PATENT DOCUMENTS 5,575,848 A * 11/1996 Chedville ..... A47J 43/04 118/13
5,799,866 A * 9/1998 Hattem ..... A47G 19/30 206/563
5,958,483 A * 9/1999 Anders ..... B65D 31/04 209/373
6,135,307 A * 10/2000 Fahy ..... A47G 19/02 220/521
D511,642 S * 11/2005 Riddell ..... D7/356
7,487,881 B2 * 2/2009 Watzke ..... B65D 1/24 220/501
8,240,503 B2 * 8/2012 Curtin ..... A47J 47/10 220/501
8,900,451 B2 * 12/2014 Cooper ..... A47J 36/20 210/232
9,004,301 B2 * 4/2015 Wahlstrom ..... A61J 1/2093 206/219
D733,503 S * 7/2015 Bagley ..... D7/629
9,221,584 B2 * 12/2015 Kleyner ..... B65D 31/12
2005/0189284 A1 * 9/2005 Burfield ..... A47J 43/22 210/369
2010/0140129 A1 * 6/2010 Sanfilippo ..... B65B 1/06 206/503
2011/0284550 A1 * 11/2011 Gersovitz ..... B65D 1/04 220/524
2013/0309515 A1 * 11/2013 Zheng ..... B32B 7/12 428/513
2014/0033658 A1 * 2/2014 Habraken ..... B65D 25/04 53/467
2014/0311955 A1 * 10/2014 Jadick ..... A47J 47/04 209/235
2014/0370162 A1 * 12/2014 Vyas ..... B65D 25/08 426/115
2016/0045076 A1 * 2/2016 de Groote ..... A47J 47/02 220/212
2016/0213201 A1 * 7/2016 Ku ..... A47J 47/04

* cited by examiner

DRY GOODS FILTERING STORAGE CONTAINER

CROSS-REFERENCE TO RELATED APPLICATIONS

This application claims benefit from the earlier filed provisional U.S. Patent Application No. 61/873,023, filed on Sep. 3, 2013, which is hereby incorporated by reference.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to a dry goods filtering storage container. Two examples of a dry goods storage container can be found at U.S. Pat. Nos. 4,836,370 and 4,889,619. However, none of the known inventions and patents, taken either singularly or in combination, is seen to describe the instant disclosure as claimed. Accordingly, an improved dry goods filtering storage container would be advantageous.

BRIEF SUMMARY OF THE INVENTION

A dry goods filtering storage container comprising dry goods container comprising a removable top portion, a body portion, a one or more chambers, a height, a width, a depth, a first side, a second side, a front side, a back side, a top, a bottom, a one or more hinged closures and a one or more lid apertures. Said one or more hinged closures are capable of selectively covering said one or more lid apertures. Said one or more chambers comprising a one or more upper chambers and a one or more lower chambers. Said one or more upper chambers are separated by a one or more horizontal dividers. Said one or more horizontal dividers having a plurality of divider apertures. Said dry goods filter storage container holds dry goods of varying sizes. Said one or more chambers being separated by a one or more vertical dividers. Said removable top portion comprises a one or more hinged closures.

BRIEF DESCRIPTION OF THE SEVERAL VIEWS OF THE DRAWING

FIGS. 5A and 5B illustrate said bottom portion of said dry goods container, and FIGS. 5C and 5D illustrate said top portion of said dry goods container.

DETAILED DESCRIPTION OF THE INVENTION

Described herein is a dry goods filtering storage container. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
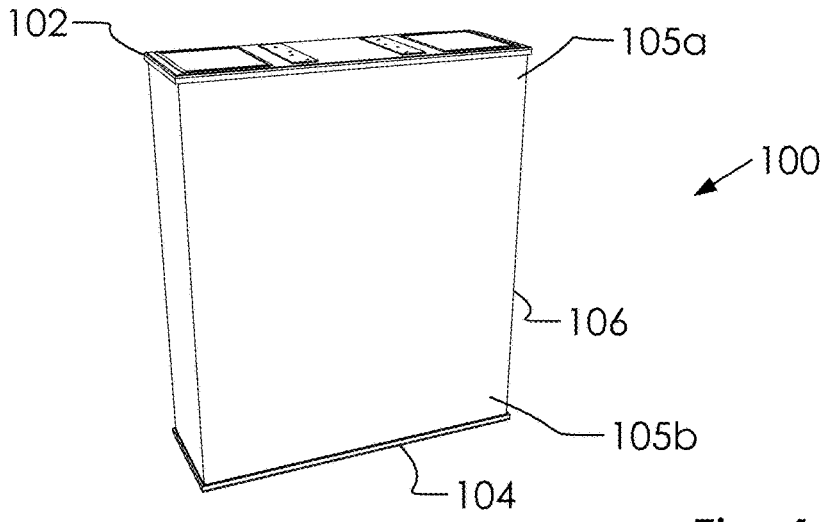
FIGS. 1A, 1B and 1C illustrate a perspective overview, an elevated front view and an elevated side view of a dry goods container.
Figure 1B:
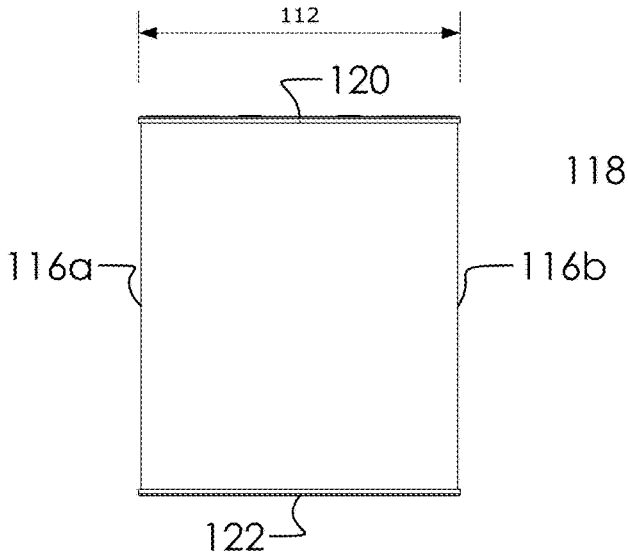
Figure 1C:
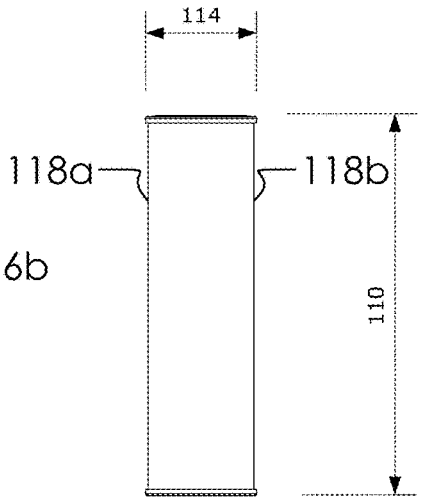

FIGS. 1A, 1B and 1C illustrate a perspective overview, an elevated front view and an elevated side view of a dry goods container 100. In one embodiment, said dry goods container can comprise a removable top portion 102, a removable bottom portion 104 and a body portion 106. In one embodiment, said dry goods container 100 can comprise a container for holding dry food goods, such as cereal. In one embodiment, said dry goods container 100 can comprise a plastic or other versatile synthetic material made from the polymerization of organic compounds. In one embodiment, said dry goods container 100 can be molded into various shapes or fabricated in many different embodiments, as disclosed herein or would be understood in the art. In one embodiment, said removable top portion 102 can attach to a top portion 105*a* of said body portion 106 and said removable bottom portion 104 can attach to a bottom portion 105*b* of said body portion 106. In one embodiment, said dry goods container 100 can comprise a height 110, a width 112 and a depth 114; wherein, said dry goods container 100 can be substantially rectangular (as illustrated here), but there is no requirement that it be rectangular to support the claims herein. In one embodiment, said dry goods container 100 can comprise a first side 116*a*, a second side 116*b*, a front side 118*a*, a back side 118*b*, a top side 120 and a bottom side 122.

Figures 2A, 2B:
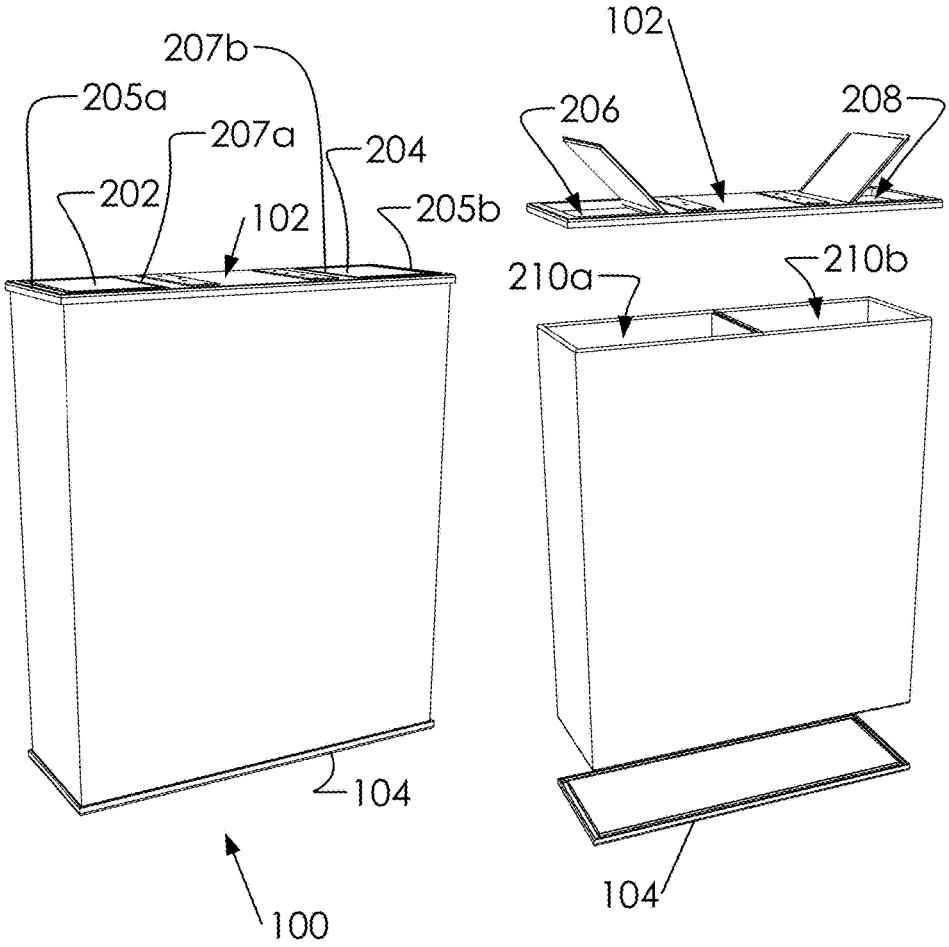
FIGS. 2A and 2B illustrate a perspective overview of said dry goods container in a non-exploded view and an exploded view.

FIGS. 2A and 2B illustrate a perspective overview of said dry goods container 100 in a non-exploded view and an exploded view. In one embodiment, said dry goods container can comprise a one or more lid apertures selectively covered by a one or more hinged closures. In one embodiment, said one or more hinged closures can comprise of a first hinged closure 202 and a second hinged closure 204. In one embodiment, said first hinged closure 202 and said second hinged closure 204 are located on said removable top portion 102. In one embodiment, said first hinged closure 202 and said second hinged closure 204 permit a contents of said dry goods container 100 to exit in a controlled manner. In one embodiment, said first hinged closure 202 and said second hinged closure 204 can be opened independent of one another. In one embodiment, removable top portion 102 can comprise a first end 205*a* and a second end 205*b*. In one embodiment, said first hinged closure 202 selectively pivots on a first hinge 207*a* and covers a first lid aperture 206, and said second hinged closure 204 pivots on a second hinge 207*b* and selectively covers said second lid aperture 208. In one embodiment, said dry goods container 100 can comprise a one or more chambers comprising, at least, a first chamber 210*a* and/or a second chamber 210*b*.

Figure 3A:
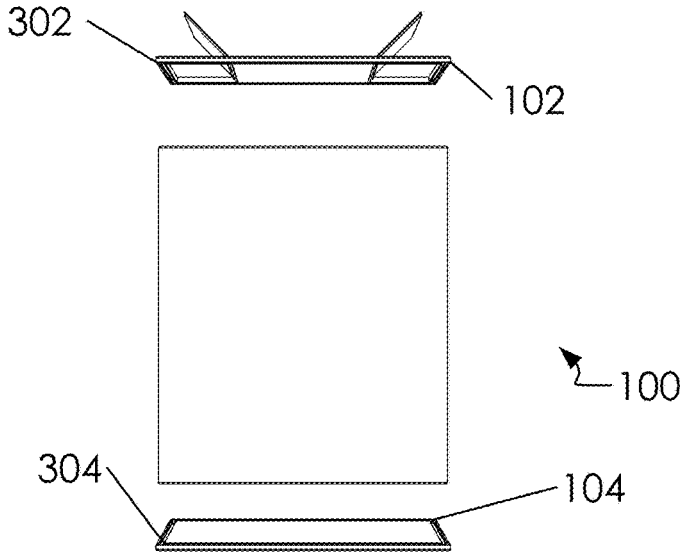
FIGS. 3A, 3B and 3C illustrate two perspective overviews of said dry goods container in an exploded view, said removable top portion, and elevated front view of a portion of said removable top portion.
Figure 3B:
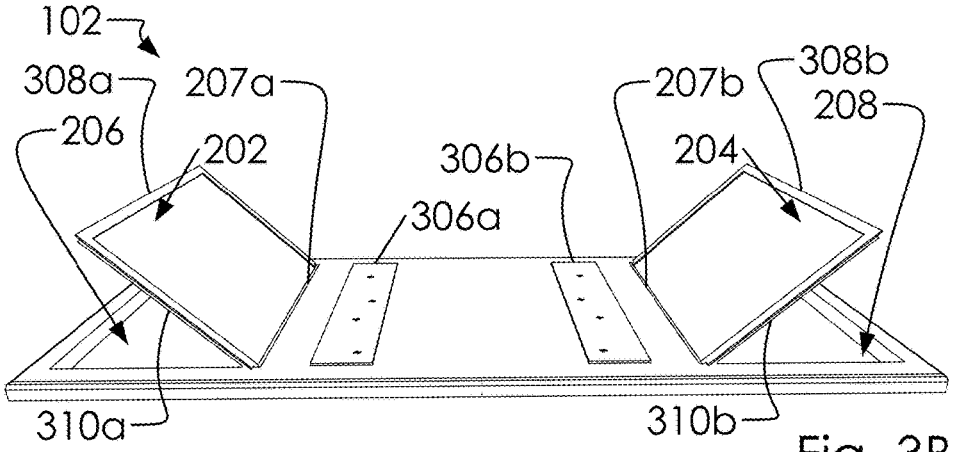
Figure 3C:
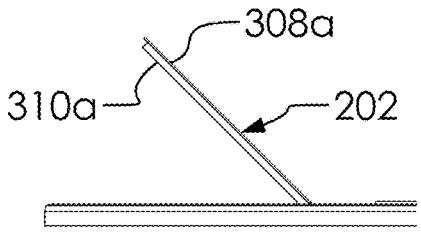

FIGS. 3A, 3B and 3C illustrate two perspective overviews of said dry goods container 100 in an exploded view, said removable top portion 102, and elevated front view of a portion of said removable top portion 102. In one embodiment, said removable top portion 102 can comprise a top lip portion 302, and said removable bottom portion 104 can comprise a bottom lip portion 304. In one embodiment, said top lip portion 302 and said bottom lip portion 304 can be useful for attaching said removable top portion 102 and said removable bottom portion 104 to said body portion 106, respectively. In one embodiment, said removable top portion 102 can comprise a one or more label areas, such as a first label area 306*a* and a second label area 306*b*; wherein, said one or more label areas can comprise a surface capable of receiving an erasable ink or marker; further wherein, said erasable ink or marker can indicate the expiration date or contents of said one or more chambers. In one embodiment, said first label area 306*a* can correspond to said first chamber 210*a*, and said second label area 306*b* can correspond to said second chamber 210*b*. In one embodiment, each of said one or more hinged closures can comprise a lip and cover portion. For example, in one embodiment, said first hinged closure 202 can comprise a first lip 308*a* and a first cover portion 310*a*, and said second hinged closure 204 can comprise a second lip 308*b* and a second cover portion 310*b*. In one embodiment, said lip of said one or more hinged closures can fit about a perimeter of said one or more hinged closures so as to create a seal around said first aperture 206 and said second aperture 208. Likewise, in one embodiment, said cover portions of said one or more hinged closures can cover said first aperture 206 and said second aperture 208.

Figure 4A:
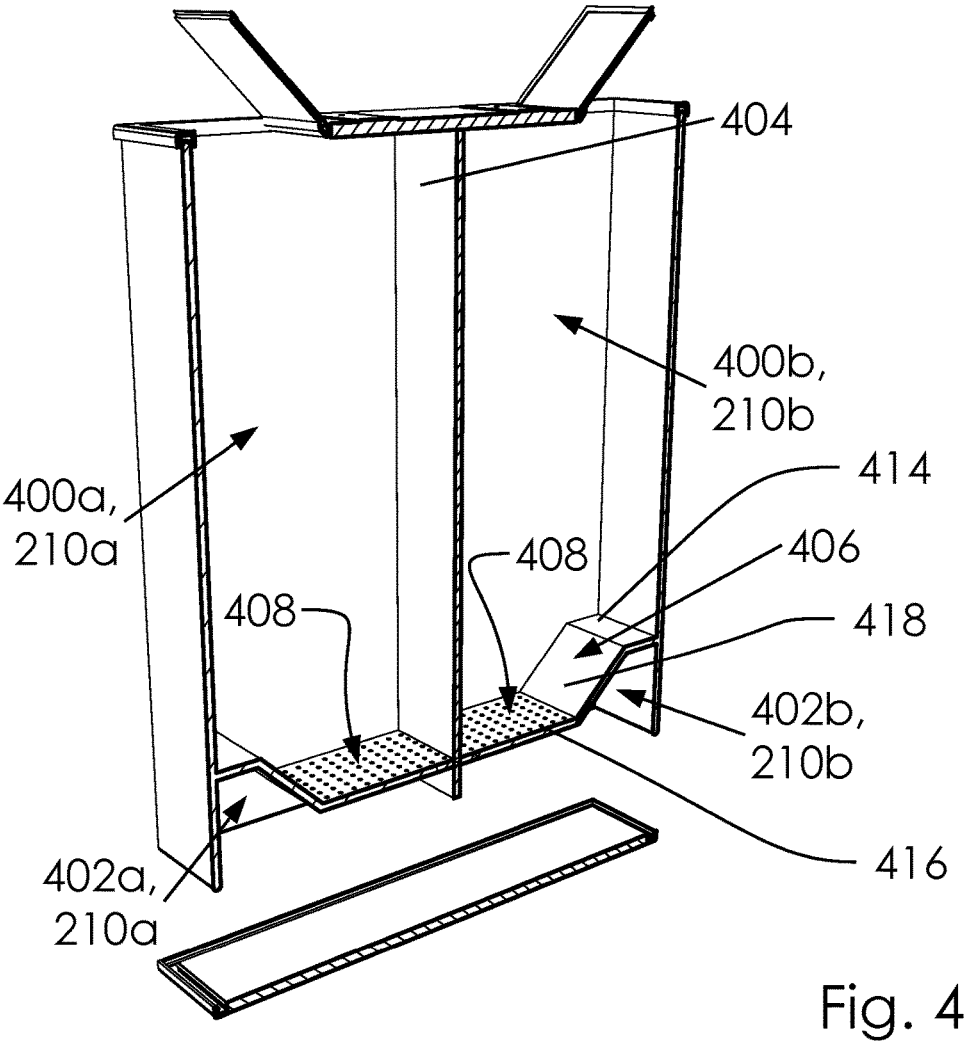
FIGS. 4A and 4B illustrate a cross-section perspective overview and elevated front view of said dry goods container.
Figure 4B:
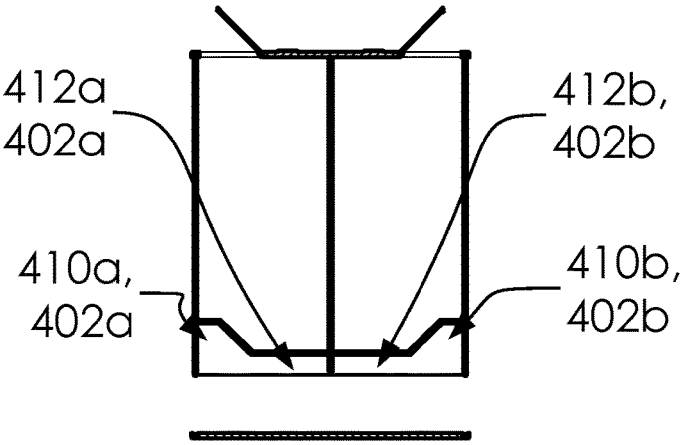

FIGS. 4A and 4B illustrate a cross-section perspective overview and elevated front view of said dry goods container 100. In one embodiment, said one or more chambers can be divided into a one or more upper chambers and a one or more lower chambers. In one embodiment, said one or more upper chambers can comprise a first upper chamber 400*a* and a second upper chamber 400*b*, and said one or more lower chambers can comprise a first chamber 210*a* and a second chamber 210*b*; wherein, said first chamber 210*a* comprises said first upper chamber 400*a* and said first lower chamber 402*a*, and said second chamber 210*b* comprises said second upper chamber 400*b* and said second lower chamber 402*b*. In one embodiment, said one or more chambers can be divided by a one or more vertical dividers (such as a first vertical divider 404) and a one or more horizontal dividers (such as a first horizontal divider 406). In one embodiment, said first horizontal divider 406 separates said first upper chamber 400*a* from said first lower chamber 402*a*, as well as separates said second upper chamber 400*b* from said second lower chamber 402*b*. Likewise, in one embodiment, said first vertical divider 404 separates said first chamber 210*a* from said second chamber 210*b*. In one embodiment, said first horizontal divider 406 can comprise a plurality of divider apertures 408, to be discussed infra. In one embodiment, said first horizontal divider can comprise a lower plane 416, an upper plane 414 and an inclined plane 418. Said plurality of divider apertures 408 can penetrate a portion of said lower plane 416. Said one or more lower chambers can comprise a raised portion 410 under said upper plane 414 and an unraised portion 412 under said lower plane 416. Said raised portion 410 can comprise a first raised portion 410*a* and a second raised portion 410*b*. Said unraised portion 412 can comprise a first unraised portion 412*a* and a second unraised portion 412*b*.

Figure 5A:
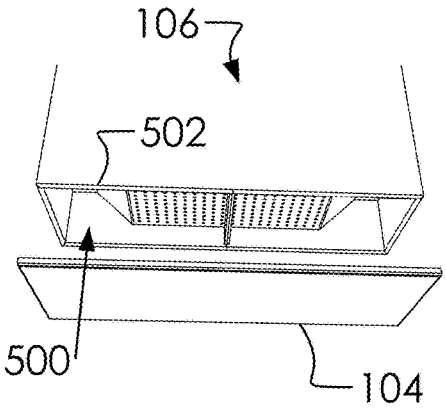
FIGS. 5A, 5B, 5C and 5D illustrate four perspective views of said dry goods container.
Figure 5B:
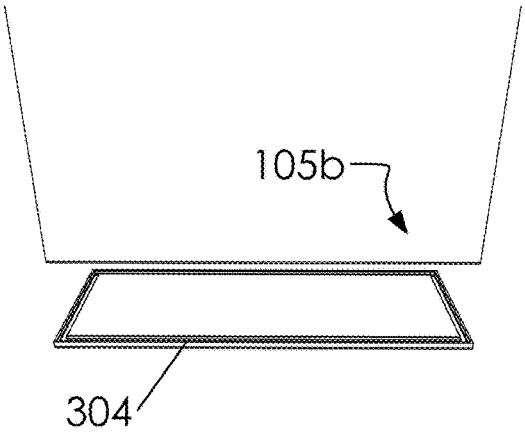
Figure 5C:
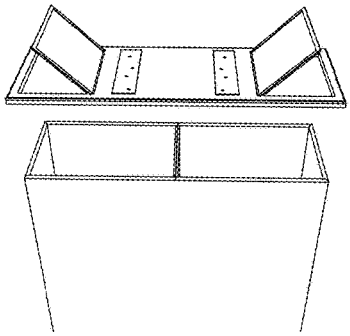
Figure 5D:
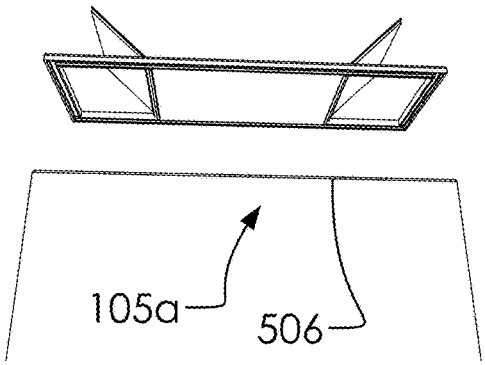

FIGS. 5A, 5B, 5C and 5D illustrate four perspective views of said dry goods container 100. FIGS. 5A and 5B illustrate said bottom portion 105*b* of said dry goods container 100, and FIGS. 5C and 5D illustrate said top portion 105*a* of said dry goods container 100. In one embodiment, said body portion 106 can comprise a bottom opening 500 and a lower rim 502; wherein, said lower rim 502 can received a portion of said removable bottom portion 104 to create a seal between said body portion 106 and said removable bottom portion 104. In one embodiment, said bottom lip portion 304 can attach to said bottom opening 500 to seal said body portion 106 to said removable bottom portion 104, as is discussed infra. In one embodiment, said removable top portion 102 and said top portion 105*a* of said body portion 106 can attach in a similar manner as said removable bottom portion 104 attaches to said bottom portion 105*b* of said body portion 106; i.e., by making a seal with an upper rim 506, as is known in the art.

Figure 6A:
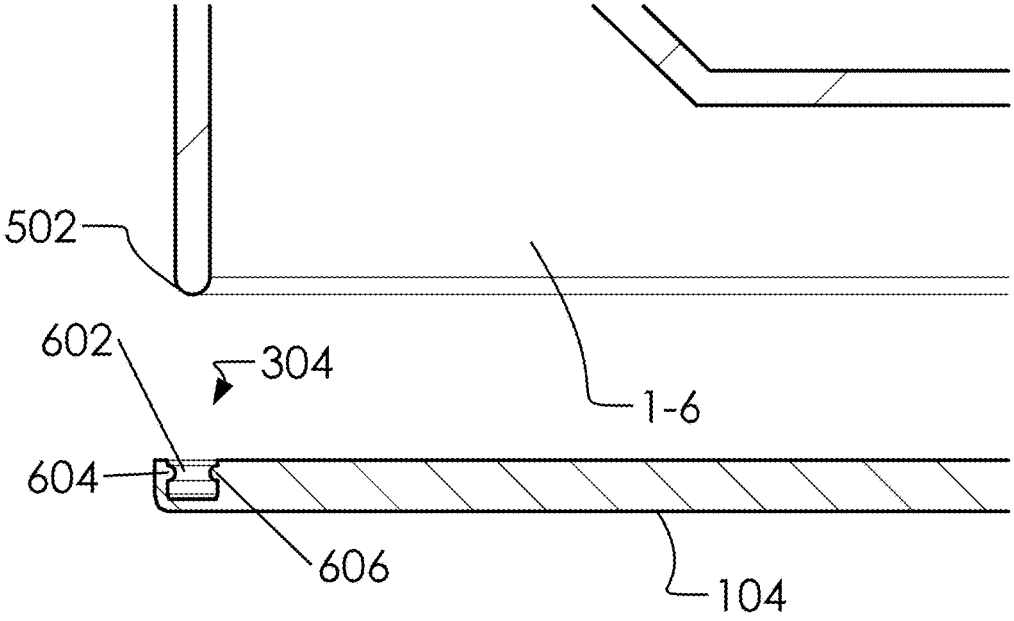
FIGS. 6A and 6B illustrate an elevated front view and a perspective overview of a cross-section of said dry goods container.
Figure 6B:
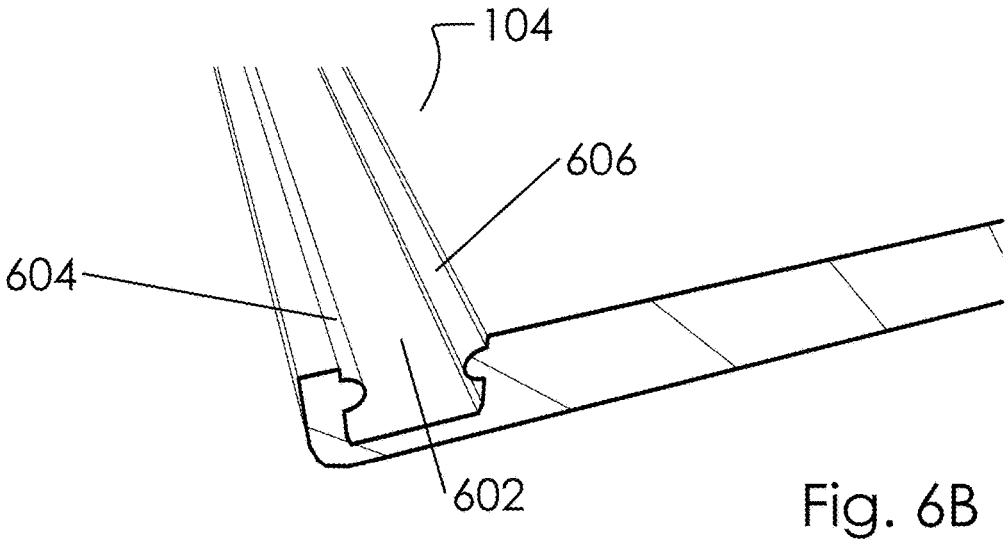

FIGS. 6A and 6B illustrate an elevated front view and a perspective overview of a cross-section of said dry goods container 100. In one embodiment, said bottom lip portion 304 can comprise a sealing indentation 602, an outer sealing ring 604 and an inner sealing ring 606. In one embodiment, said lower rim 502 of said body portion 106 can fit into said sealing indentation 602 while said outer sealing ring 604 squeezes an outside portion of said lower rim 502 and said inner sealing ring 606 squeezes an inside portion of said lower rim 502. A similar attachment happens at said top portion 105*a* between said body portion 106 and said removable top portion 102 in said top lip portion 302; wherein said top lip portion 302 comprises a sealing indentation, an outer sealing ring and an inner sealing ring (none illustrated here) with similar capabilities.

Figure 7A:
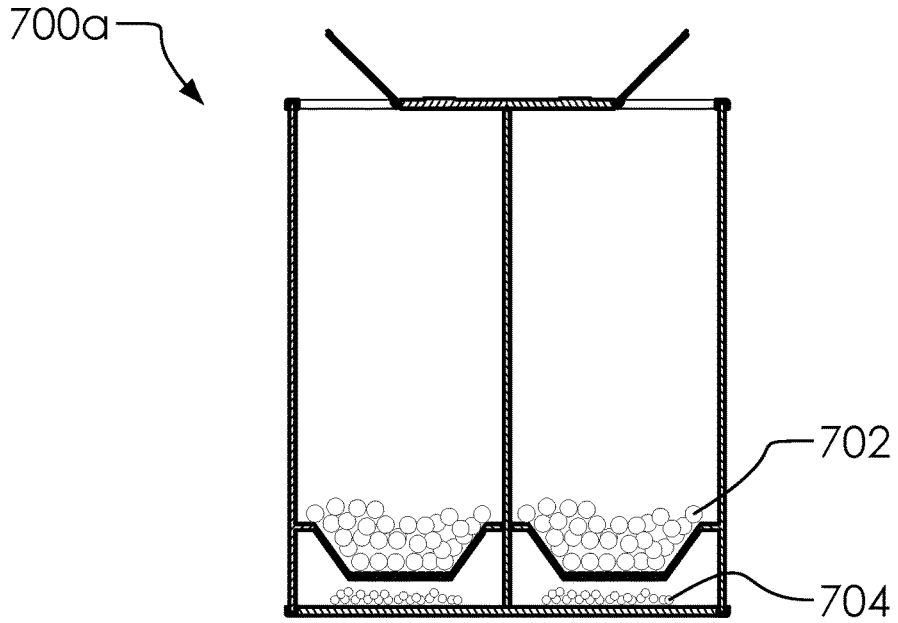
FIGS. 7A and 7B illustrate front cross-section views of said dry goods container in an upright configuration and a pouring configuration.
Figure 7B:
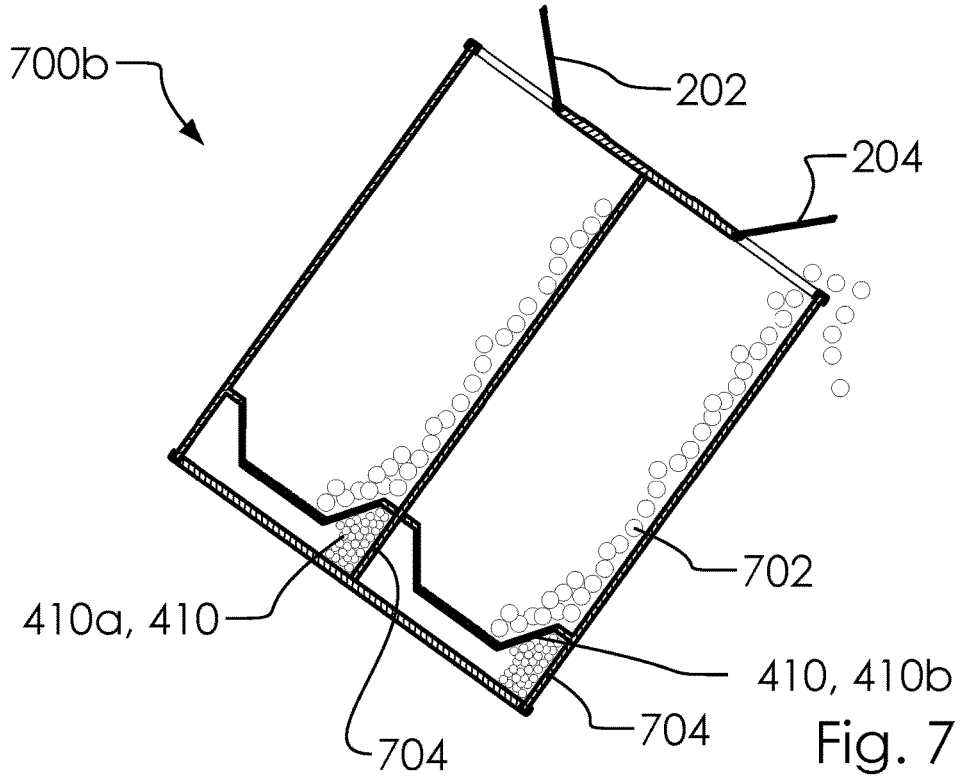

FIGS. 7A and 7B illustrate front cross-section views of said dry goods container 100 in an upright configuration 700*a* and a pouring configuration 700*b*. In one embodiment, said first horizontal divider 406 with said plurality of divider apertures 408 can filter a one or more crumbs 704 into said one or more lower chambers while a large dry goods 702 remain accessible within said one or more upper chambers of said dry goods container 100. In one embodiment, when said dry goods container 100 is tilted so that dry goods can exit said dry goods container dry goods container 100. In one embodiment, said one or more crumbs 704 can become entrapped within said raised portion 410 of said one or more lower chambers with said dry goods container 100 in said pouring configuration 700*b*.

Figure 8A:
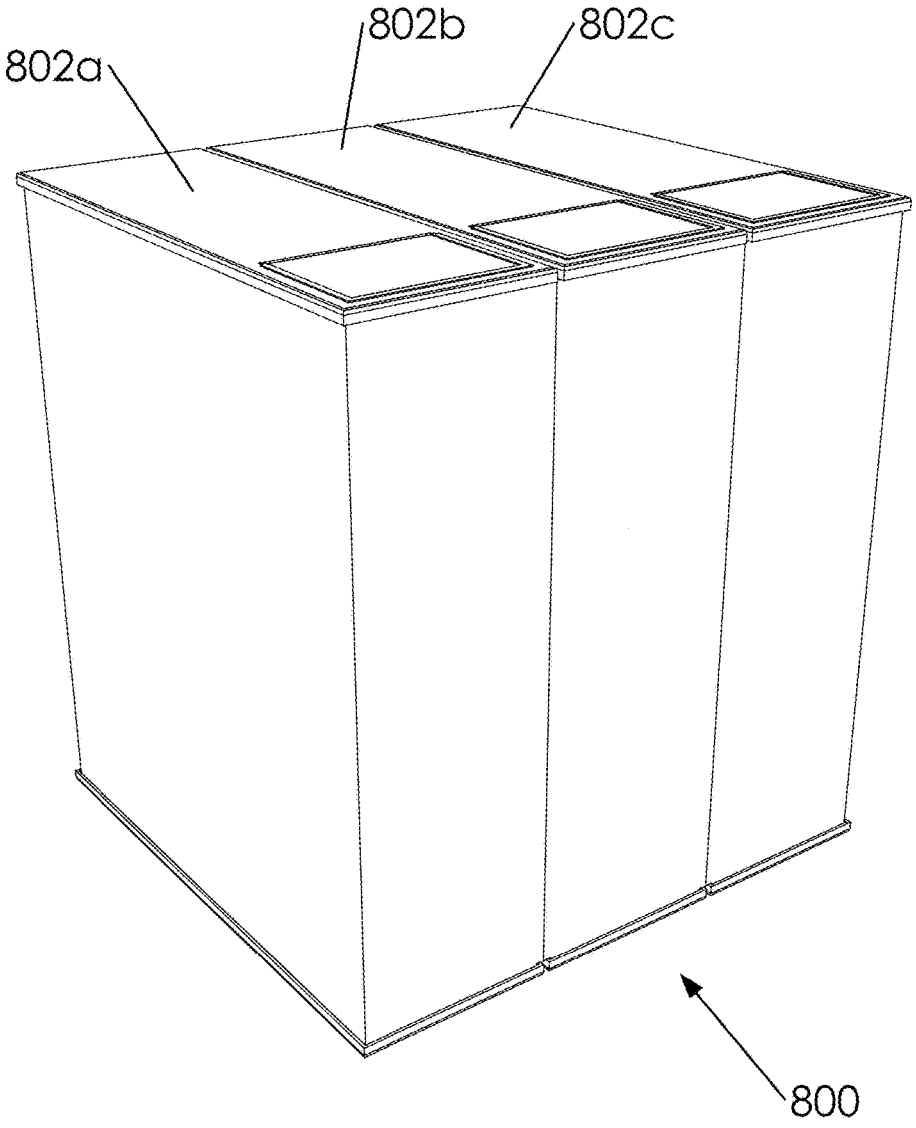
FIGS. 8A, 8B and 8C illustrate two perspective overviews and a perspective cross-section front side view of a separable dry goods container.
Figure 8B:
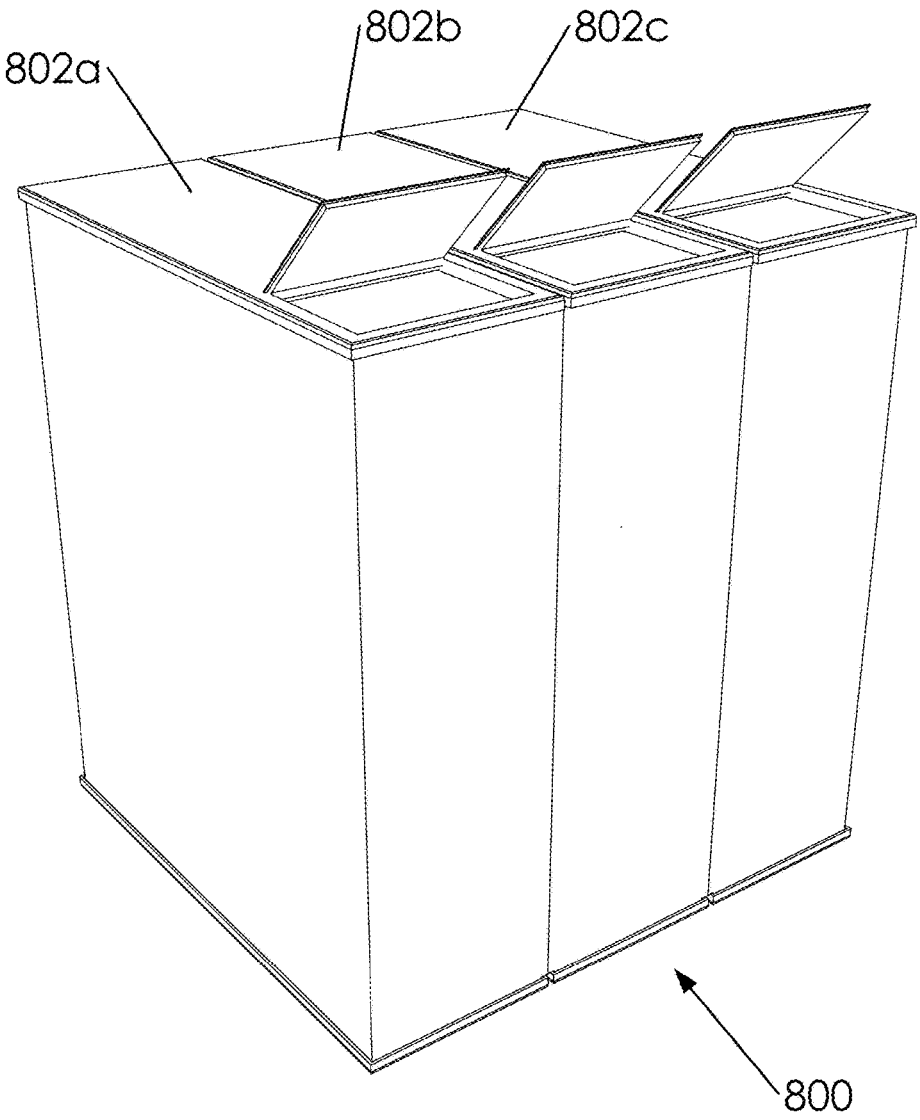
Figure 8C:
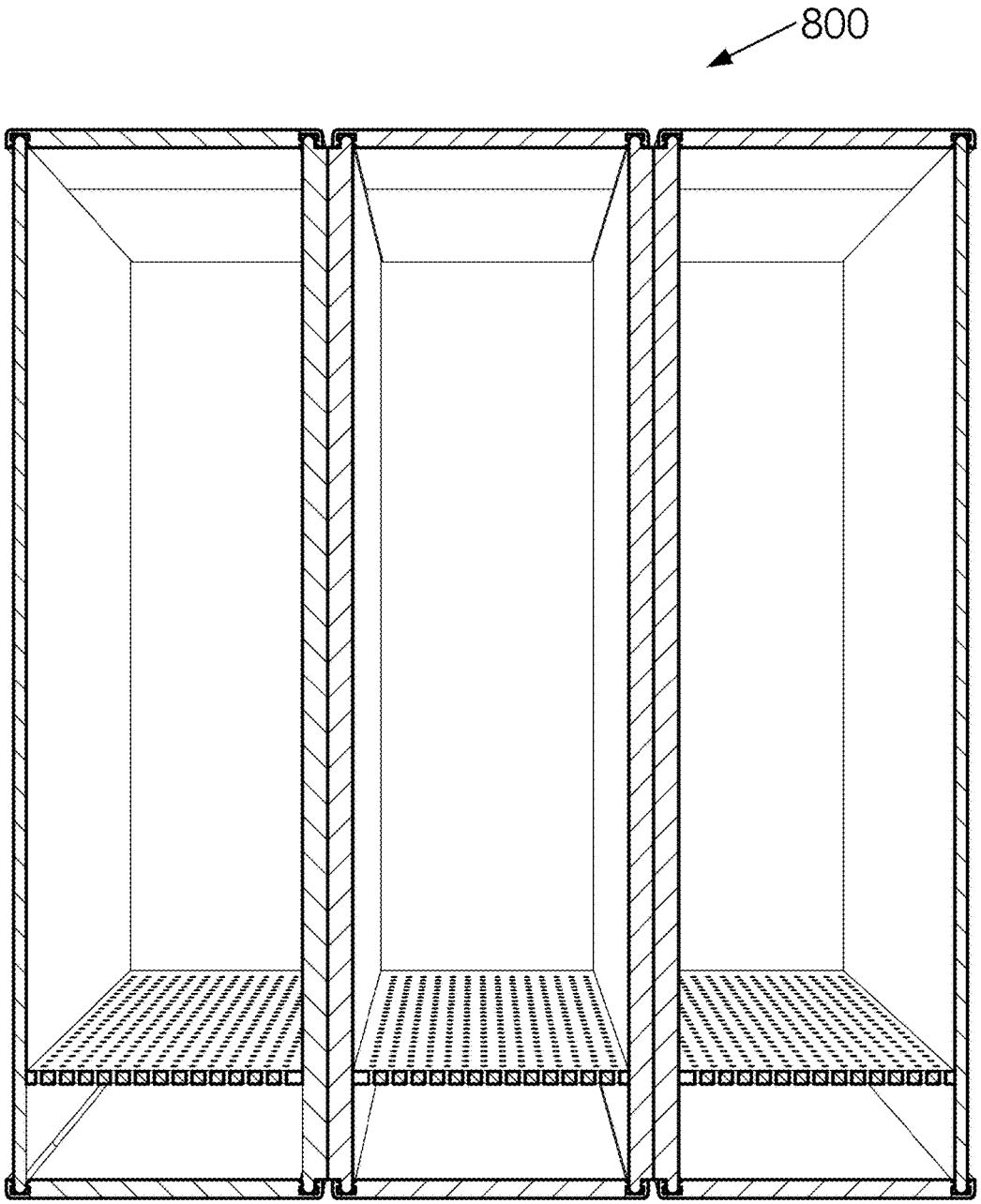

FIGS. 8A, 8B and 8C illustrate two perspective overviews and a perspective cross-section front side view of a separable dry goods container 800. In one embodiment, said separable dry goods container 800 can comprise a two or more detachable chambers, such as a first dry goods container 802*a*, a second dry goods container 802*b* and/or a third dry goods container 802*c*. In one embodiment, said two or more detachable chambers can be selectively attached and detached from one another, as illustrated. Said two or more chambers can be attached to one another by sliding a portion of said first dry goods container 802*a* into a portion of said second dry goods container 802*b* or, otherwise, attaching them to one another with an adhesive or hook-and-loop fasteners.

Figure 9A:
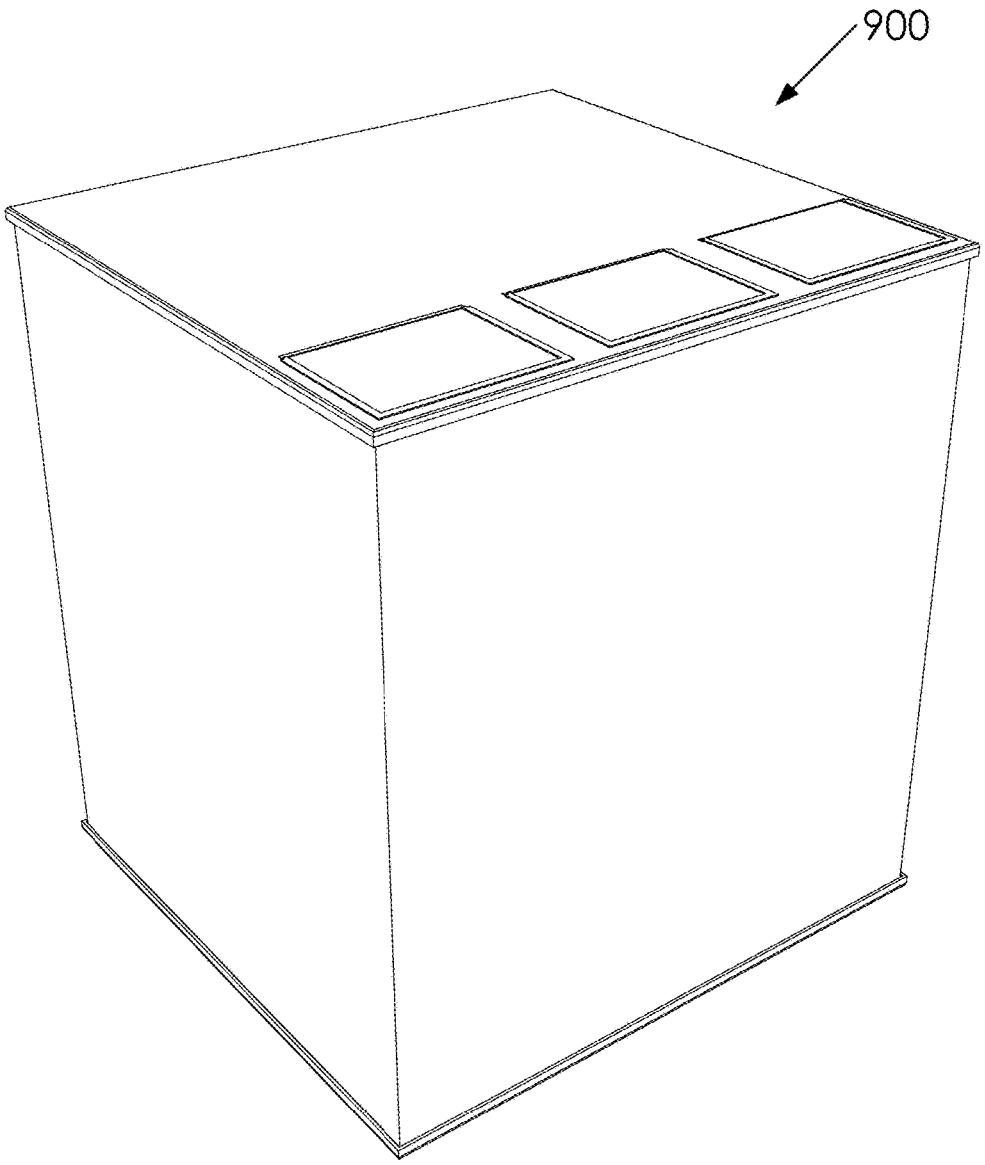
FIGS. 9A, 9B and 9C illustrate two perspective overviews and a front cross-section view of a three-part dry goods container.
Figure 9B:
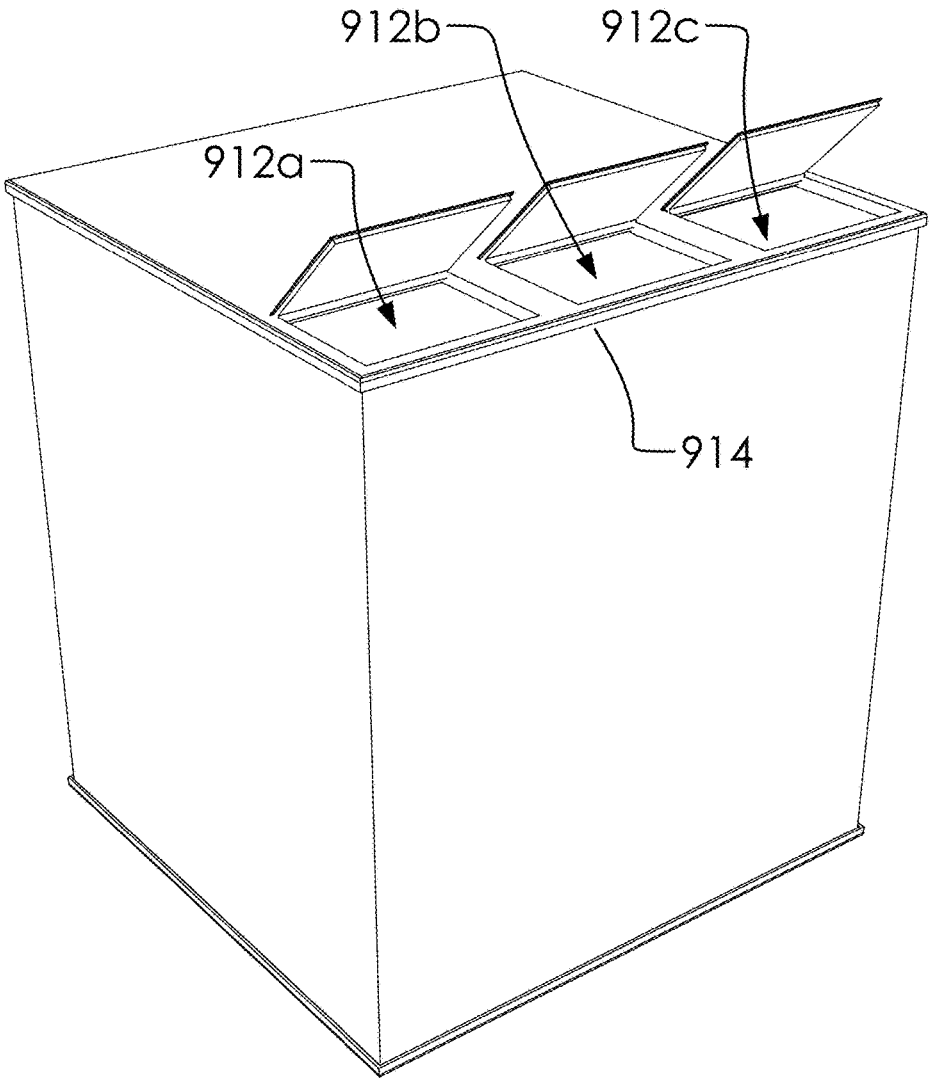
Figure 9C:
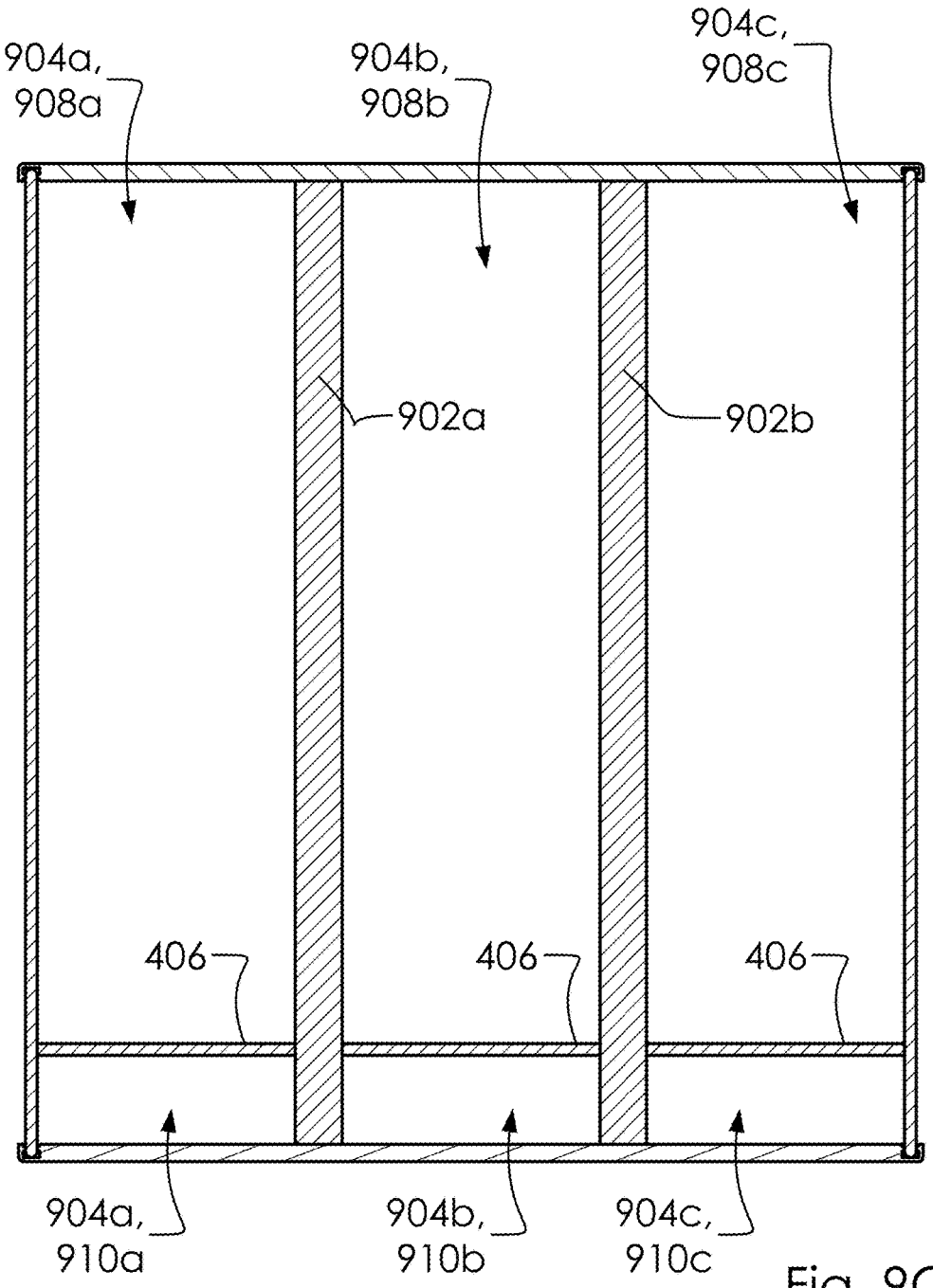

FIGS. 9A, 9B and 9C illustrate two perspective overviews and a front cross-section view of a three-part dry goods container 900. In one embodiment, said three-part dry goods container 900 can be a variation on said dry goods container 100; wherein, said one or more vertical dividers can comprise a first vertical divider 902*a* and a second vertical divider 902*b*, and said one or more chambers can comprise a first chamber 904*a*, a second chamber 904*b*, and a third chamber 904*c*. Likewise, in one embodiment, said one or more horizontal dividers can comprise said first horizontal divider 406 dividing said one or more chambers into said one or more upper chambers (comprising a first upper chamber 908*a*, a second upper chamber 908*b* and a third upper chamber 908*c*) and a one or more lower chambers (comprising a first lower chamber 910*a*, a second lower chamber 910*b*, and a third lower chamber 910*c*). In one embodiment, said one or more chambers of said three-part dry goods container 900 can each comprise one of a one or more hinged closures (comprising a first hinged closure 912*a*, a second hinged closure 912*b* and a third hinged closure 912*c*). In one embodiment, said one or more hinged closures of said three-part dry goods container 900 can function in substantially the same manner as said one or more hinged closures of said dry goods container 100. In one embodiment, wherein said one or more chambers comprise a three or more chambers, as illustrated in FIGS. 9A-9C, said one or more hinged closures can be aligned on a first edge 914 of said three-part dry goods container 900. That is, said three or more chambers can open at the same end of said three-part dry goods container 900 to accommodate pouring said large dry goods 702 from said three-part dry goods container 900.

Figure 10:
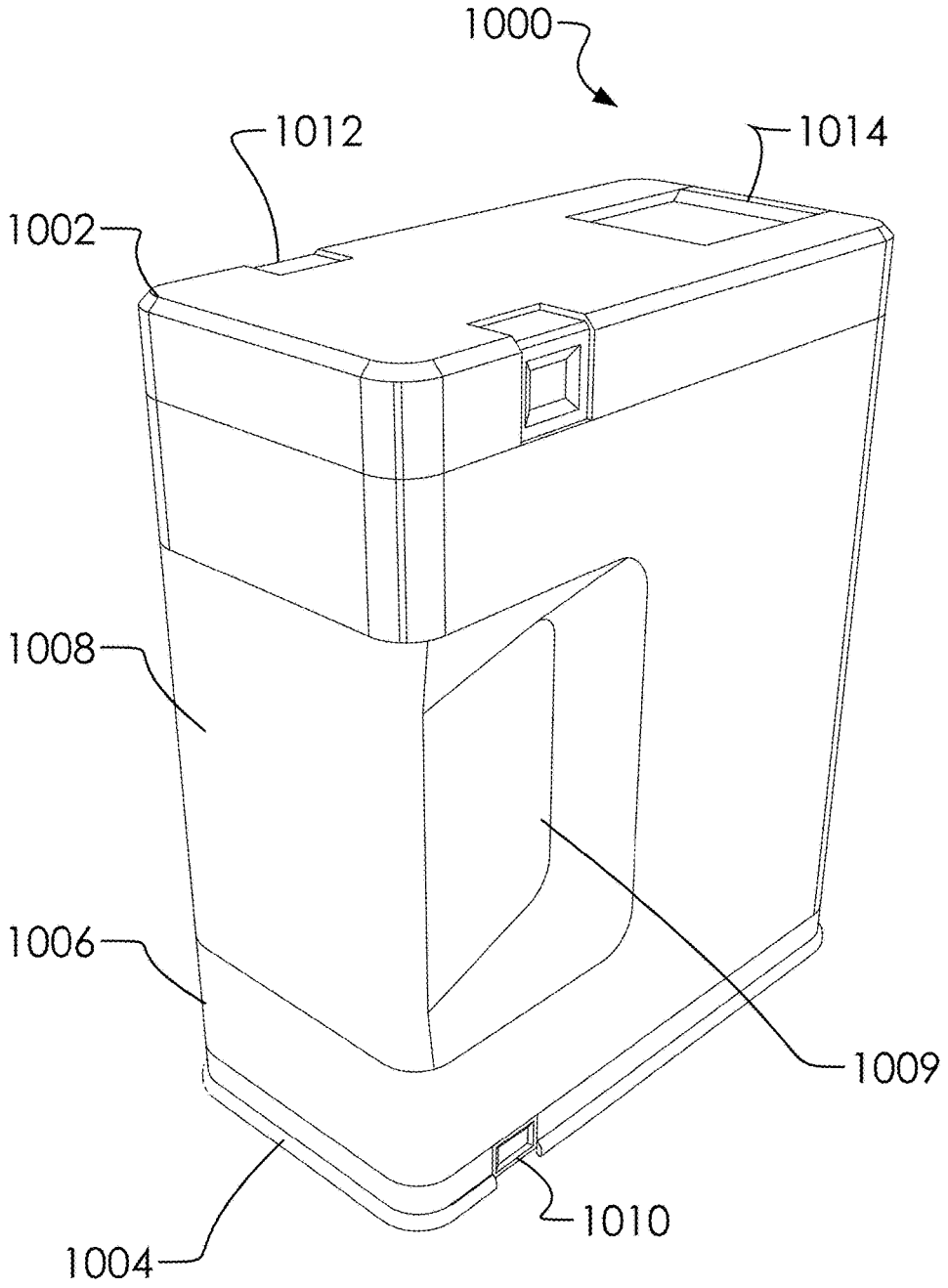
FIG. 10 illustrates a perspective overview of a dry goods container.

FIG. 10 illustrates a perspective overview of a dry goods container 1000. In one embodiment, said dry goods container 1000 can comprise a removable top portion 1002, a removable bottom portion 1004, and a body portion 1006. In one embodiment, said body portion 1006 can comprise a handle portion 1008. In one embodiment, said handle portion 1008 can comprise a one or more side indentions 1009 into said body portion 1006 to facilitate grabbing said dry goods container 1000. In one embodiment, said removable bottom portion 1004 can comprise a one or more release clips (which can comprise a first release clip 1010*a* and a second release clip 1010*b*), and said removable top portion 1002 can comprise a one or more release clips (which can comprise a first release clip 1012*a* and a second release clip 1012*b*). In one embodiment, said removable top portion 1002 can comprise said one or more hinged closures (which can comprise an upper hinged closure 1014).

Figure 11:
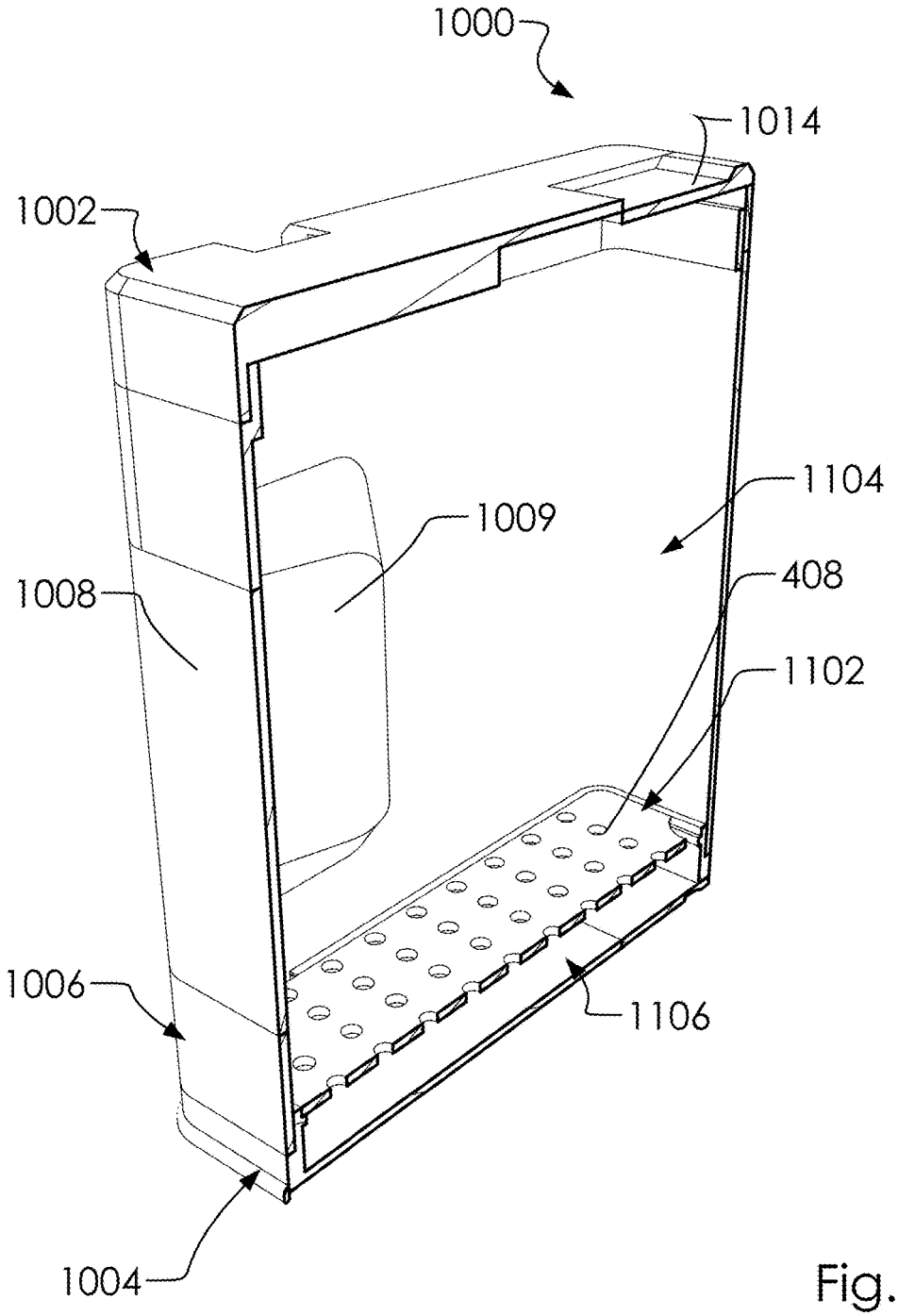
FIG. 11 illustrates a cross-section perspective overview of said dry goods container, exposing said one or more chambers therein. In one embodiment, said dry goods container can comprise a horizontal divider attached between said one or more upper chambers (which can comprise an upper chamber) and said one or more lower chambers (which can comprise a lower chamber).

FIG. 11 illustrates a cross-section perspective overview of said dry goods container 1000, exposing said one or more chambers therein. In one embodiment, said dry goods container 1000 can comprise a horizontal divider 1102 attached between said one or more upper chambers (which can comprise an upper chamber 1104) and said one or more lower chambers (which can comprise a lower chamber 1106). In one embodiment, said horizontal divider 1102 can comprise said plurality of divider apertures 408. In one embodiment, said upper hinged closure 1014 can open and close by sliding in a horizontal plane as would be known in the art.

Figure 12:
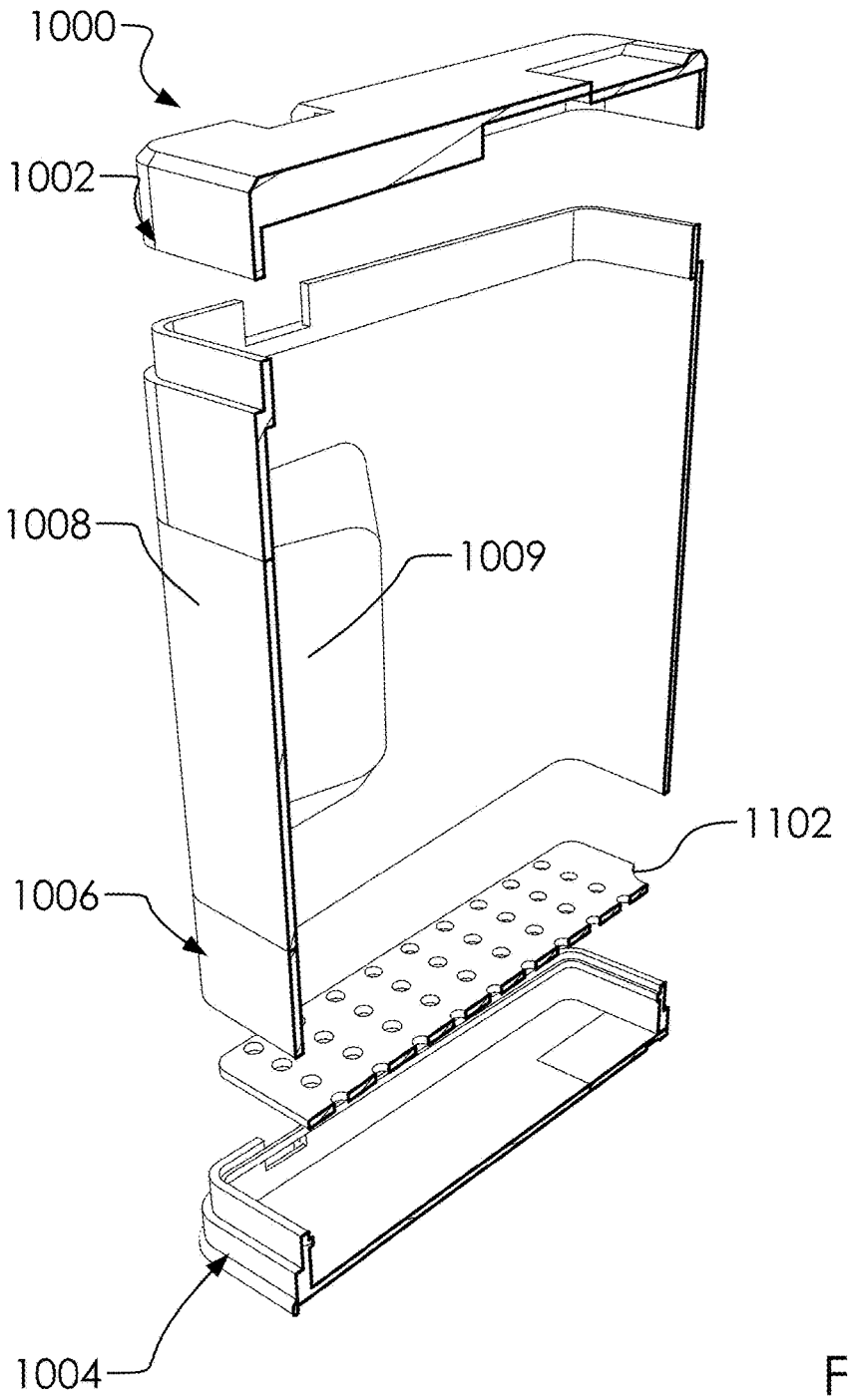
FIG. 12 illustrates a cross-section, exploded, perspective overview of said dry goods container.
Figure 13A:
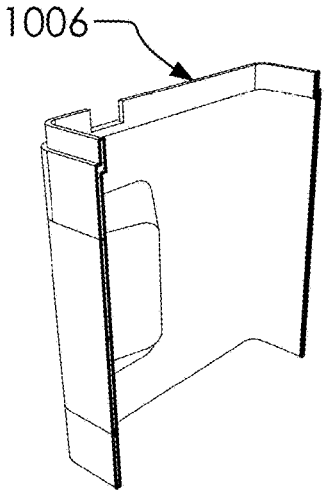
FIGS. 13A, 13B, 13C, 13D, 13E and 13F illustrate a cross-section perspective overview, a perspective overview, an elevated front view, an elevated side view, an elevated rear view, and an elevated top view of said body portion.
Figure 13B:
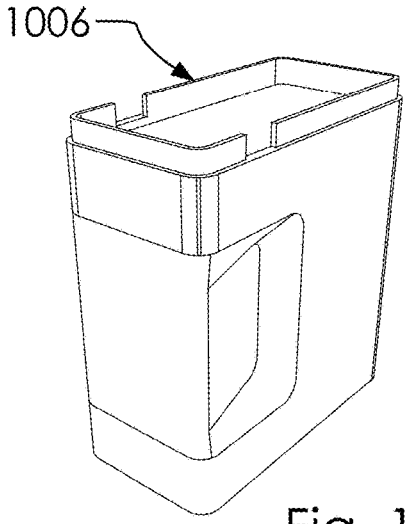
Figure 13C:
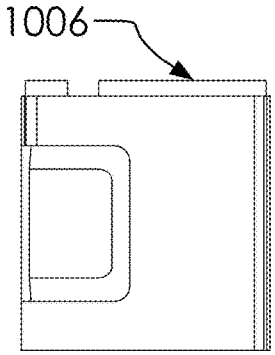
Figure 13D:
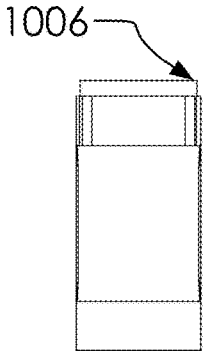
Figure 13E:
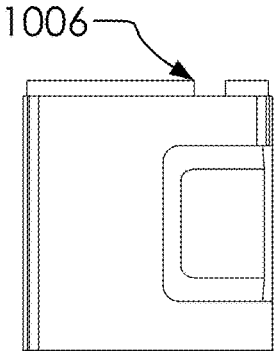
Figure 13F:
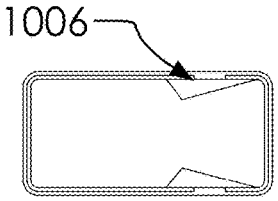

FIG. 12 illustrates a cross-section, exploded, perspective overview of said dry goods container 1000.

FIGS. 13A, 13B, 13C, 13D, 13E and 13F illustrate a cross-section perspective overview, a perspective overview, an elevated front view, an elevated side view, an elevated rear view, and an elevated top view of said body portion 1006.

Figure 14A:
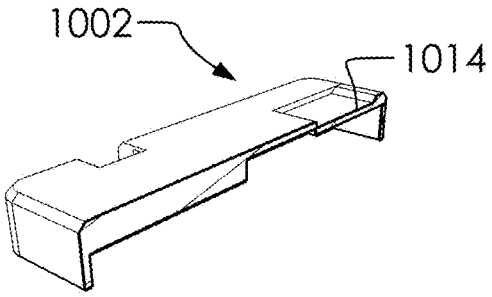
FIGS. 14A, 14B, 14C and 14D illustrate a cross-section perspective overview, a perspective overview, an elevated front view, and an elevated top view of said removable top portion.
Figure 14B:
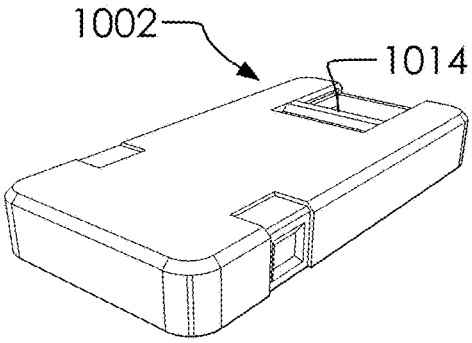
Figure 14C:
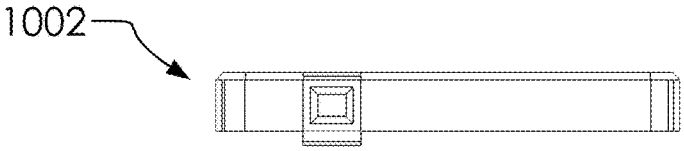
Figure 14D:
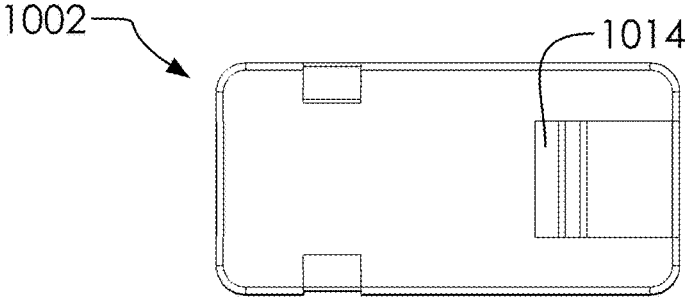

FIGS. 14A, 14B, 14C and 14D illustrate a cross-section perspective overview, a perspective overview, an elevated front view, and an elevated top view of said removable top portion 1002. FIG. 14A illustrates said upper hinged closure 1014 in a closed configuration and FIGS. 14B-14D illustrate said upper hinged closure 1014 in an open configuration.

Figure 15A:
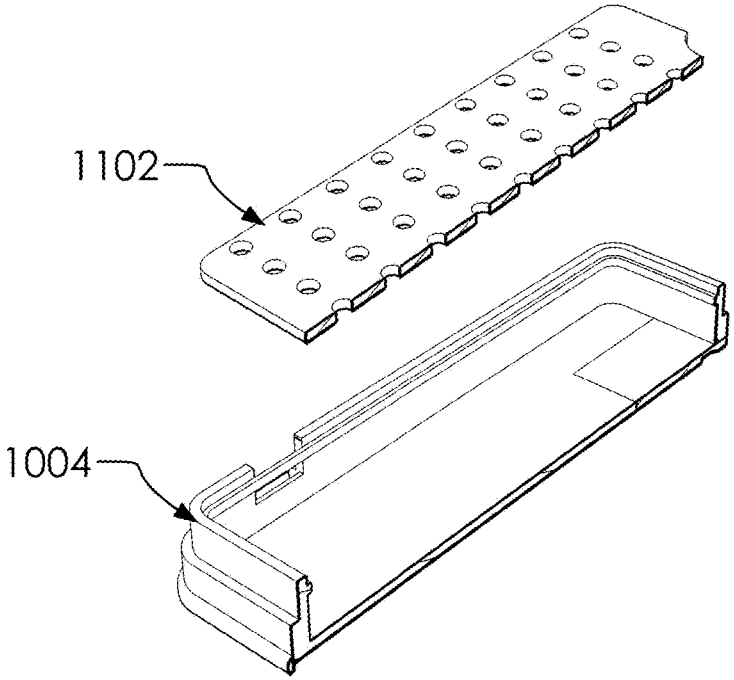
FIGS. 15A and 15B illustrate a cross-section perspective overview and a perspective overview of said horizontal divider and said removable bottom portion.
Figure 15B:
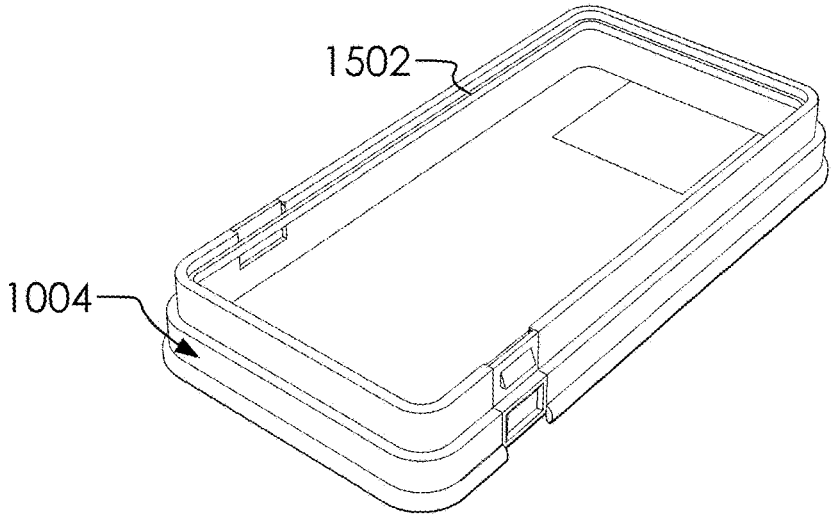

FIGS. 15A and 15B illustrate a cross-section perspective overview and a perspective overview of said horizontal divider 1102 and said removable bottom portion 1004. In one embodiment, said removable top portion 1002 can comprise an inner ledge 1502 upon which said horizontal divider 1102 can be secured, as illustrated.

Figure 16A:
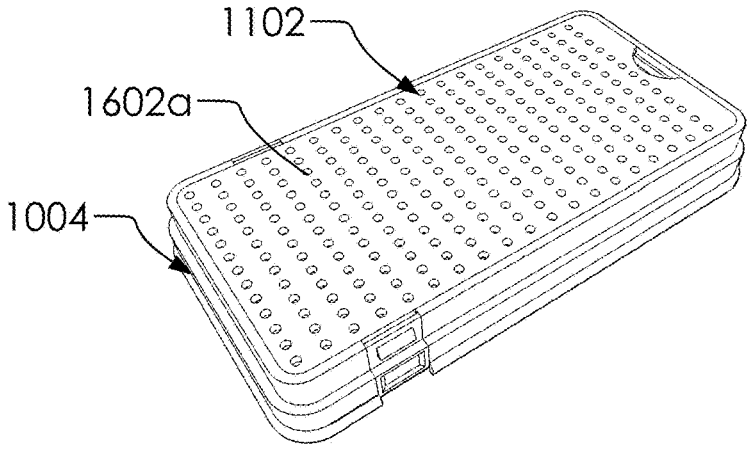
FIGS. 16A, 16B and 16C illustrate a perspective overview of said removable bottom portion with three embodiments of said horizontal divider.
Figure 16B:
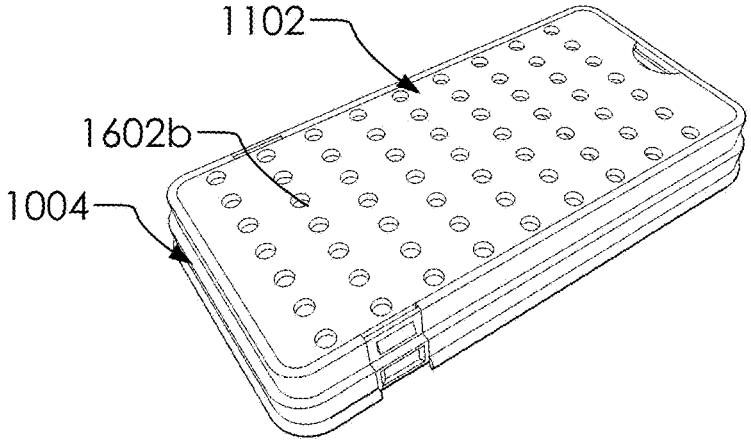
Figure 16C:
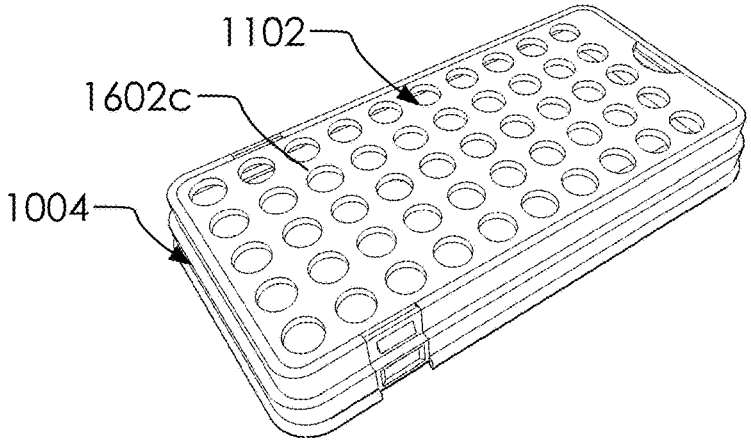

FIGS. 16A, 16B and 16C illustrate a perspective overview of said removable bottom portion 1004 with three embodiments of said horizontal divider 1102. In one embodiment, said plurality of divider apertures 408 of said horizontal divider 1102 can comprise a range of different diameters selected among a one or more horizontal dividers; wherein, said one or more horizontal dividers can comprise a first divider 1602*a* (having smaller apertures), a second divider 1602*b* (having medium sized apertures) and a third divider 1602*c* (having larger apertures). As is known, sizes and diameters are relative and the sizes and densities included herewith are illustrative; it is further understood that the sizes of said plurality of divider apertures 408 can be custom determined according to said one or more crumbs 704 and said large dry goods 702 stored in said dry goods container 1000. In one embodiment, said horizontal divider 1102 can be interchanged to alter the characteristics of said plurality of divider apertures 408, as illustrated.

Figure 17A:
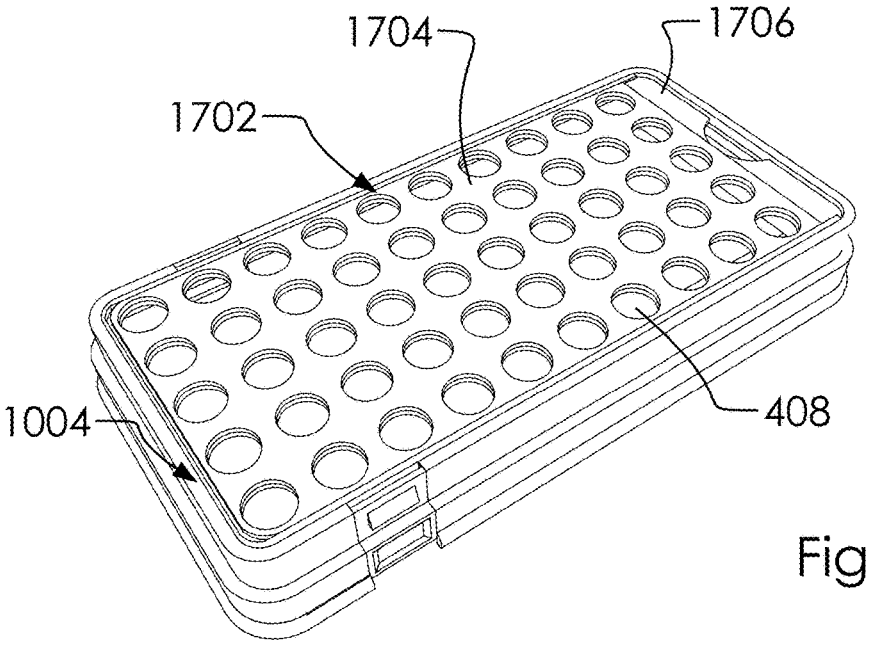
FIGS. 17A and 17B illustrate a perspective overview of said removable bottom portion with a variable horizontal divider.
Figure 17B:
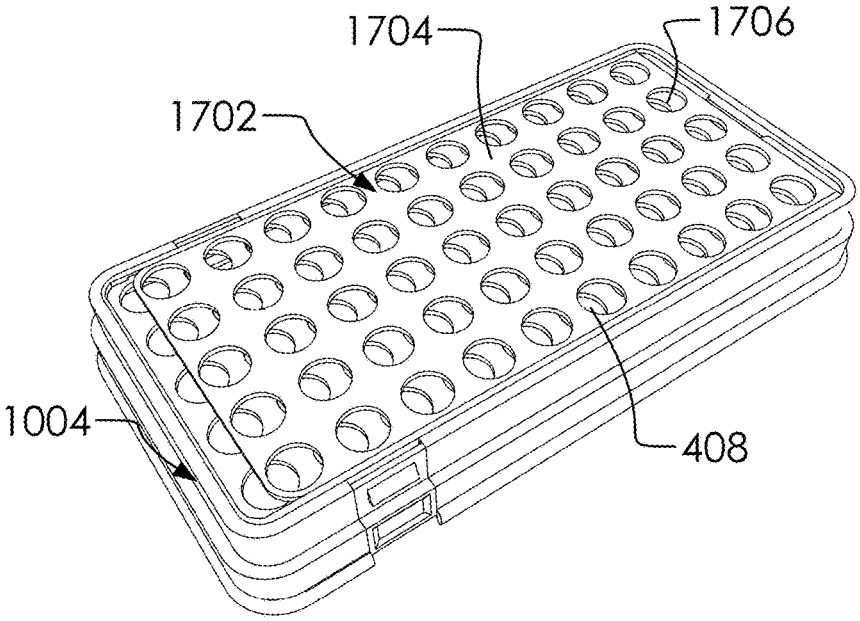

FIGS. 17A and 17B illustrate a perspective overview of said removable bottom portion 1004 with a variable horizontal divider 1702. In one embodiment, said variable horizontal divider 1702 can comprise a first plate 1704 and a second plate 1706, each comprising a portion of said plurality of divider apertures 408. In one embodiment, said first plate 1704 can slide relative to and substantially within a plane defined by the shared surfaces between said first plate 1704 and said second plate 1706. In one embodiment, said plurality of divider apertures 408 can change shape according to the changing profile of apertures between said first plate 1704 and said second plate 1706, as illustrated.

Figure 18A:
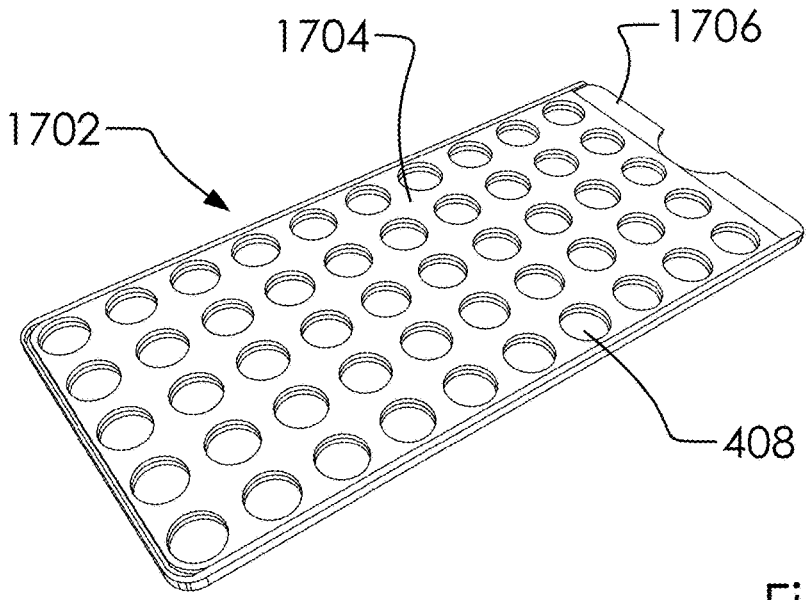
FIGS. 18A and 18B illustrate said variable horizontal divider in an open configuration and a partially open configuration.
Figure 18B:
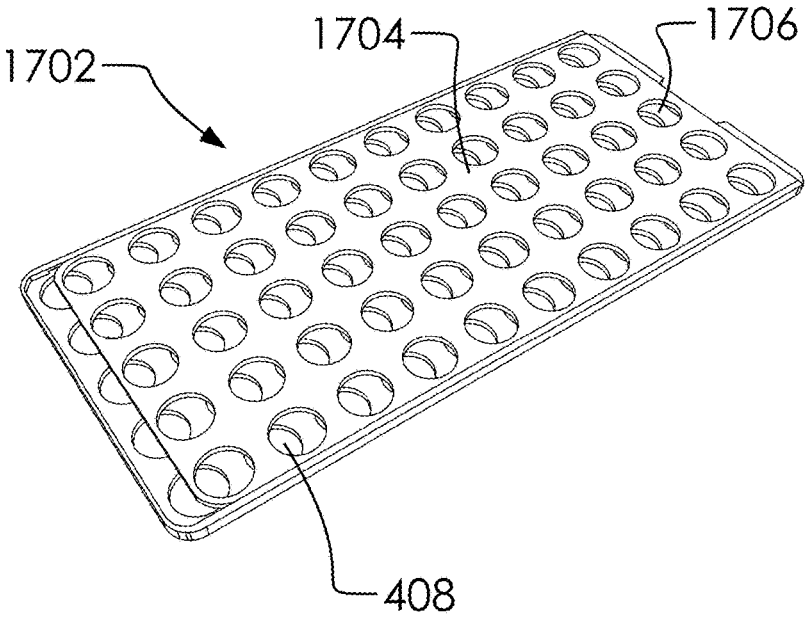

FIGS. 18A and 18B illustrate said variable horizontal divider 1702 in an open configuration and a partially open configuration.

Figure 19A:
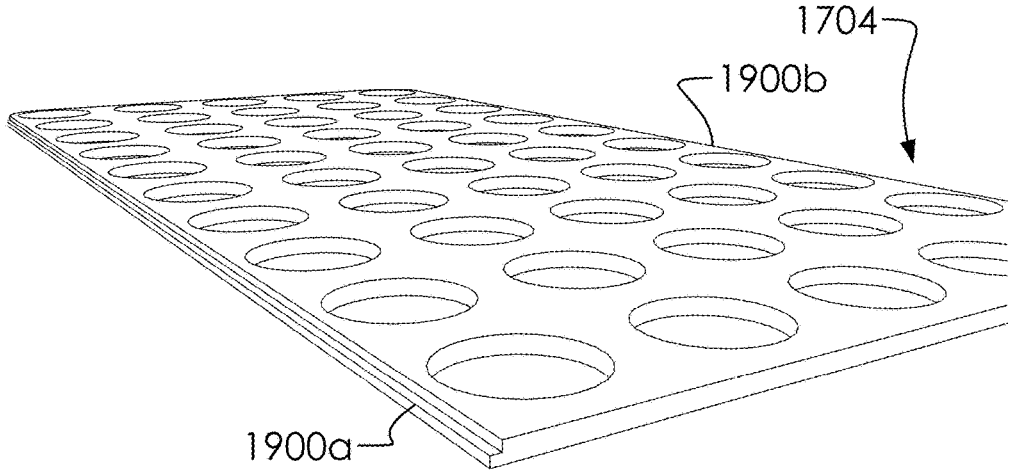
FIGS. 19A and 19B illustrate a perspective side view of said first plate and said second plate, respectively.
Figure 19B:
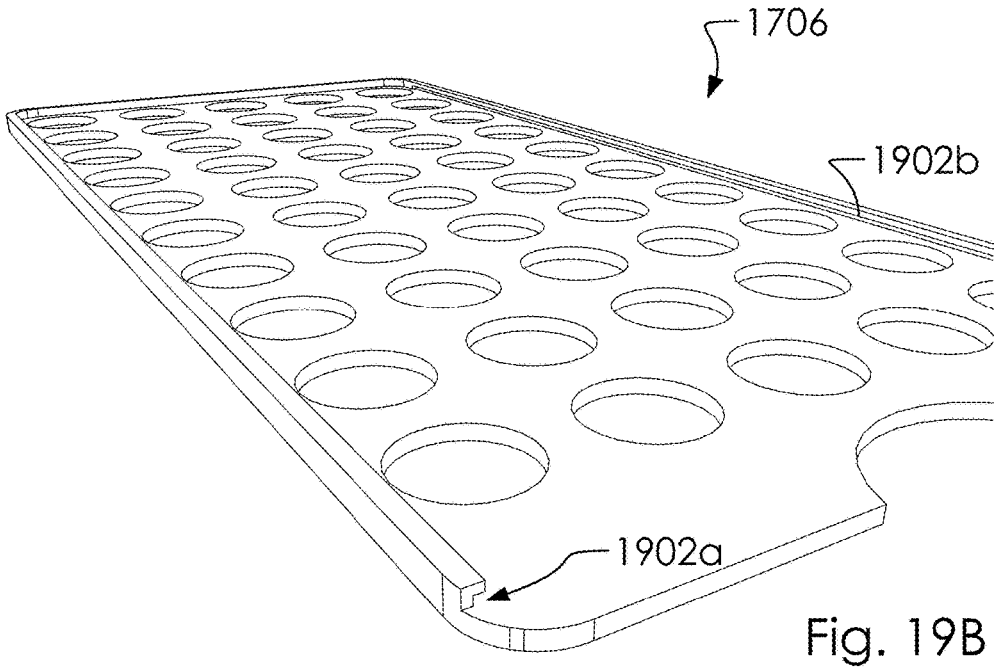
Figure 20A:
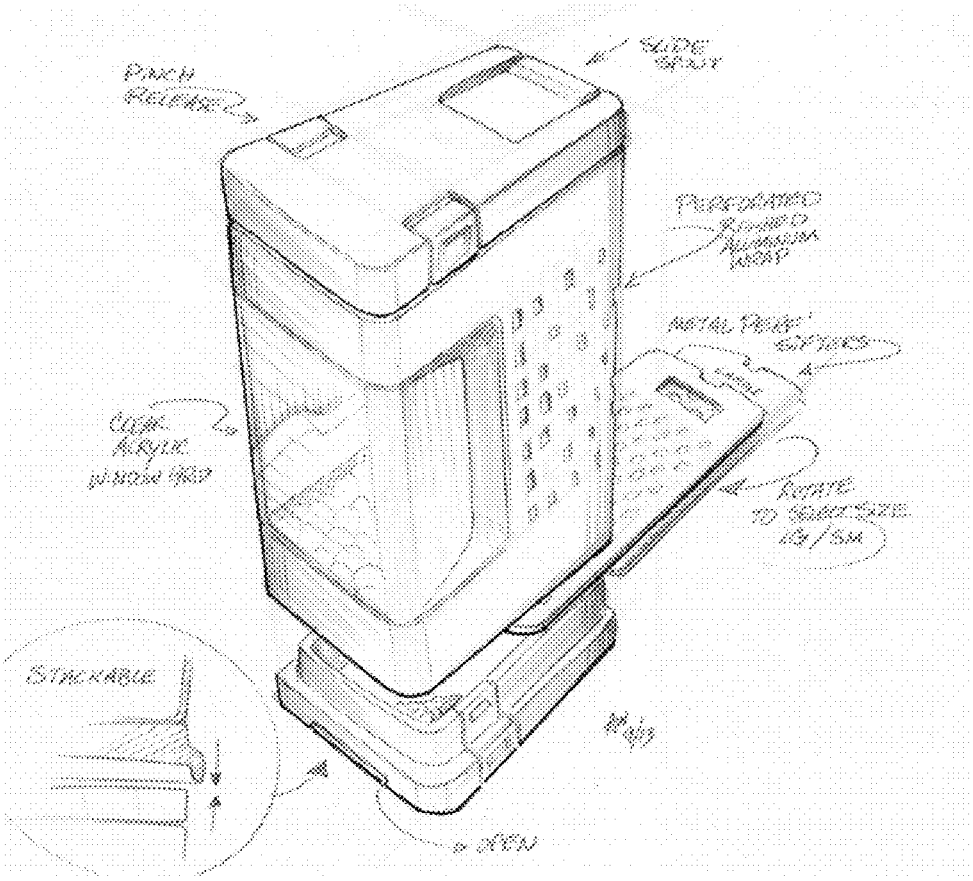
FIGS. 20A, 20B, 20C, 20D and 20E illustrate perspective overview illustrations of variations on said dry goods container and said dry goods container.
Figure 20B:
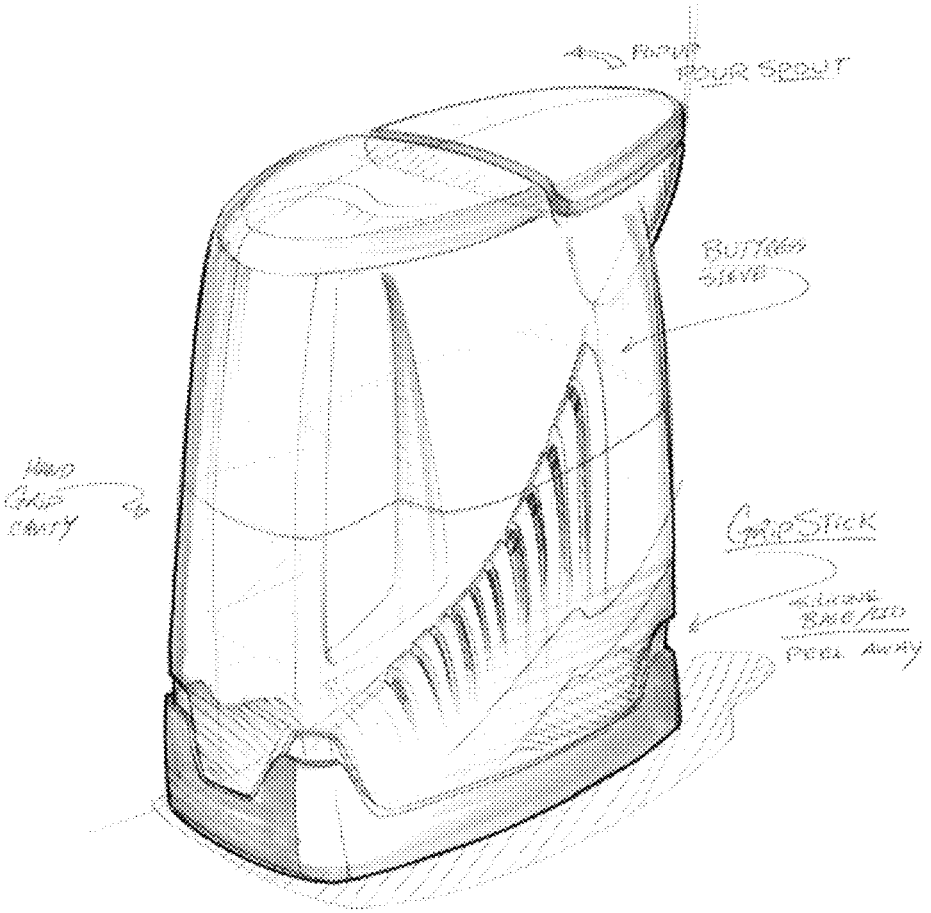
Figure 20C:
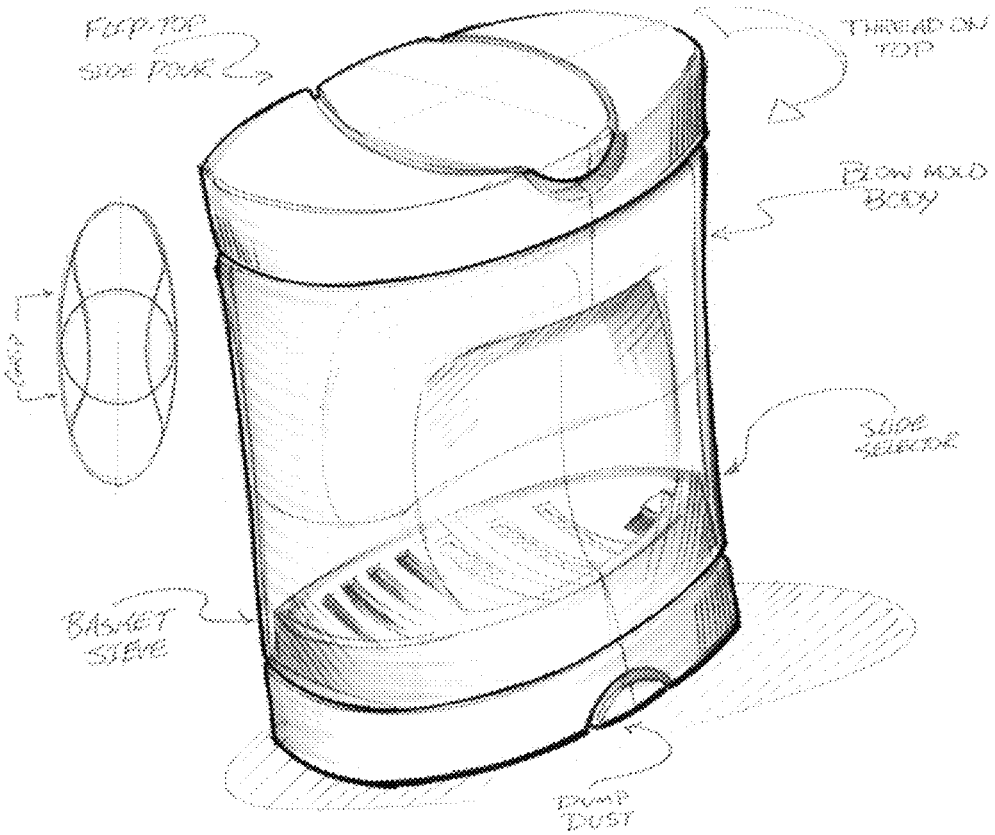
Figure 20D:
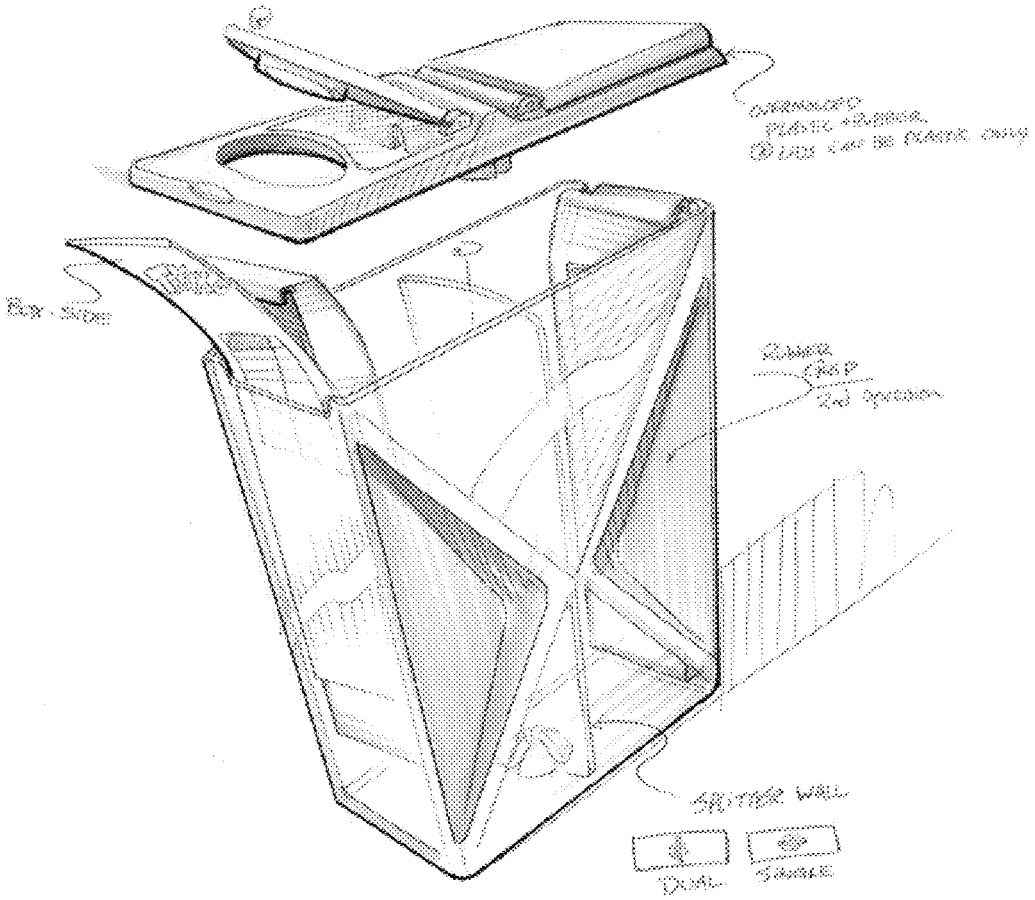
Figure 20E:
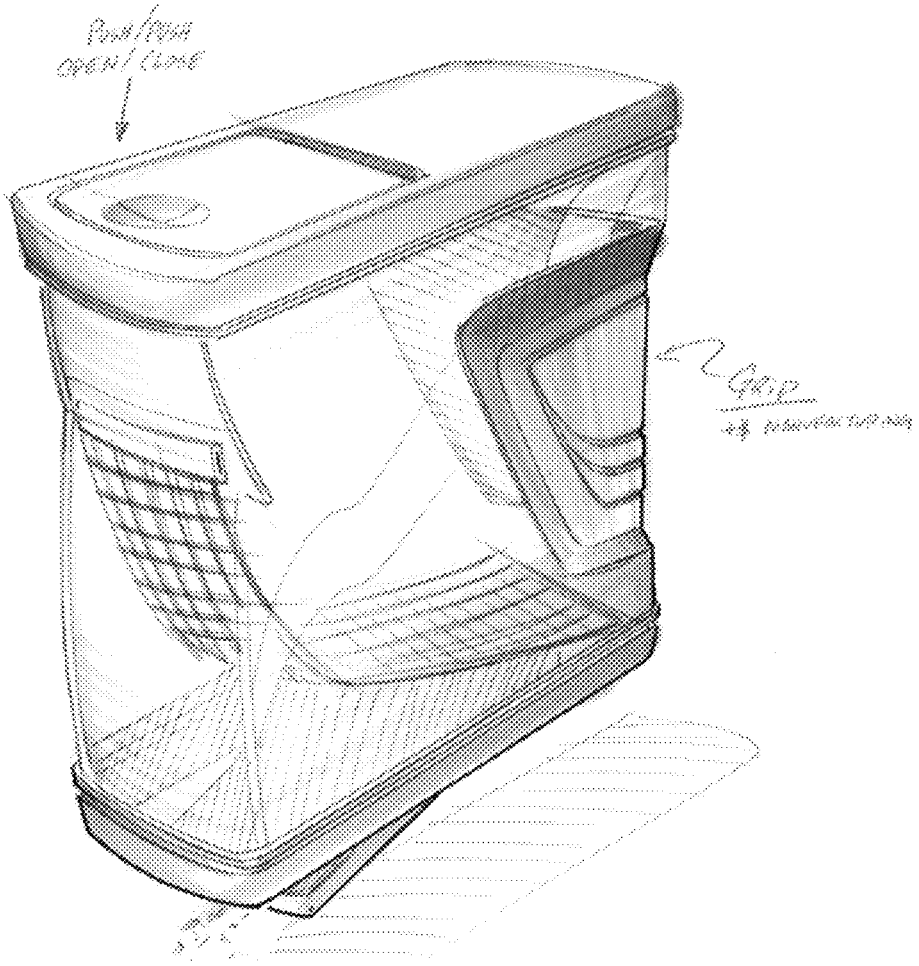

FIGS. 19A and 19B illustrate a perspective side view of said first plate 1704 and said second plate 1706, respectively. In one embodiment, said second plate 1706 can comprise a track having a first track 1902*a* and a second track 1902*b*. In one embodiment, said first plate 1704 can comprise a one or more rails which can comprise a first rail 1900*a* and a second rail 1900*b*. In one embodiment, said one or more rails selectively slide within said track.

FIGS. 20A, 20B, 20C, 20D and 20E illustrate perspective overview illustrations of variations on said dry goods container 100 and said dry goods container 1000.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A dry goods filtering storage container comprising:

a dry goods container comprising a removable top portion, a body portion, a two or more chambers, a height, a width, a depth, a first side, a second side, a front side, a back side, a top, a bottom, a one or more hinged closures and a one or more lid apertures;

said one or more hinged closures are configured for selectively covering said one or more lid apertures;

said two or more chambers comprising a one or more upper chambers and a one or more lower chambers;

said one or more upper chambers and said one or more lower chambers are separated by a one or more horizontal dividers;

said one or more horizontal dividers comprise a lower plane, an upper plane and an inclined plane;

a plurality of divider apertures are in a portion of said lower plane;

said one or more lower chambers comprise a raised portion under said upper plane and an unraised portion under said lower plane;

said dry goods container is configured to filter a one or more crumbs from a large dry goods with said plurality of divider apertures;

said raised portion of said one or more lower chambers are arranged around an exterior edge of said one or more lower chambers at locations arranged beneath said one or more lid apertures;

tilting said dry goods container from an upright configuration to a pouring configuration comprises rotating said dry goods container to pour out portions of said large dry goods;

said raised portion of said one or more lower chambers are configured to entrap a portion of said one or more crumbs with said dry goods container in a tilted angle or pouring configuration;

said dry goods filter storage container is configured to hold a dry goods of varying sizes;

said removable top portion comprises said one or more hinged closures.

2. The dry goods filtering storage container of claim 1 wherein, said plurality of divider apertures are smaller than said large dry goods;

said plurality of divider apertures are larger than said one or more crumbs; and said plurality of divider apertures in said one or more horizontal dividers are configured for filtering said one or more crumbs into said one or more lower chambers while keeping said large dry goods in said one or more upper chambers.

3. The dry goods filtering storage container of claim 1 wherein, said two or more chambers comprise a first chamber having a first upper chamber and a second upper chamber;

said two or more chambers comprise a second chamber having a second upper chamber and a second lower chamber;

said one or more vertical dividers comprise a first vertical divider separating said first upper chamber from said first lower chamber, and separating said second upper chamber from said second lower chamber; and said one or more horizontal dividers comprise a first horizontal divider separating said first chamber from said second chamber.

4. The dry goods filtering storage container of claim 3 wherein, said one or more hinged closures in said top portion of said dry goods container comprise a first hinged closure and a second hinged closure; and said first hinged closure is arranged above said first chamber and said second hinged second hinged closure is arranged above said second chamber.

5. The dry goods filtering storage container of claim 1 wherein, said one or more hinged closures comprise a lip and a cover portion; and further wherein, selectively covering said one or more lid apertures with said one or more hinged closures comprise covering said one or more lid apertures with said cover portion of said one or more closures and sealing said one or more lid apertures with said lip of said one or more closures.

6. The dry goods filtering storage container of claim 1 wherein, said top portion of said dry goods container is capable of selectively attaching to said body portion.

7. The dry goods filtering storage container of claim 6 wherein, said top portion comprises a top lip portion;

said body portion comprises an upper rim;

said top lip portion attaches to said upper rim by inserting said upper rim into said top lip portion, and holding said upper rim in said top lip portion with friction.

8. The dry goods filtering storage container of claim 7 wherein, said dry goods container further comprises a removable bottom portion;

said bottom portion comprises a bottom lip portion;

said body portion comprises a lower rim;

said bottom lip portion attaches to said upper rim by inserting said upper rim into said bottom lip portion, and holding said upper rim in said bottom lip portion with friction.

* * * * *